United States Patent [19]

Lardi

[11] 4,035,624

[45] July 12, 1977

[54] SYSTEM FOR OPERATING A STEAM TURBINE WITH IMPROVED SPEED CHANNEL FAILURE DETECTION

[75] Inventor: Francesco Lardi, Pittsburgh, Pa.

[73] Assignee: Westinghouse Electric Corporation, Pittsburgh, Pa.

[21] Appl. No.: 407,011

[22] Filed: Oct. 16, 1973

Related U.S. Application Data

[63] Continuation of Ser. No. 247,597, April 26, 1972, abandoned.

[51] Int. Cl.[2] ..... H02P 9/04; G05B 15/00; F01D 17/02; G06F 15/06

[52] U.S. Cl. ..... 235/151.21; 290/40 R; 60/645; 415/15; 364/300

[58] Field of Search ..... 235/151.21, 151.34, 235/151.3, 151; 415/1, 13, 15, 17; 60/39.28 R, 73, 105, 145, 146; 290/40 R, 40.2, 2; 340/172.5; 444/1

[56] References Cited

U.S. PATENT DOCUMENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,588,265 | 6/1971 | Berry | 415/17 X |

OTHER PUBLICATIONS

Application of the Prodac 50 System to Direct Digital Control, J. C. Belz, G. J. Kirk & P. S. Radcliffe, IEEE Intl. Conv. Rec., Part 3, 1965, pp. 102–122.

Monitoring and Automatic Control in Steam Power Stations by Process Computer, E. Doetsch & G. Hirschberg, Siemens Review XXXV (1968) No. 12, pp. 471–476.

*Primary Examiner*—Edward J. Wise

*Attorney, Agent, or Firm*—H. W. Patterson

[57] ABSTRACT

A digital computer control system for operating a steam turbine in an electric power plant is disclosed. Under automatic control, the digital computer calculates a steam flow demand signal for positioning the steam inlet valves. A speed feedback loop is used to modify the steam flow demand signal as required to maintain the desired speed. The speed loop selects a first or second of three independently generated speed signals depending on the difference between the three speed signals. The first speed signal is a digital signal; and the second is an analog signal, which is converted to a digital signal. The digital signal consists of a fine and a coarse speed signal which is selected in accordance with turbine speed to constitute the first generated speed signal.

12 Claims, 40 Drawing Figures

REFDMD
SPEED FEEDBACK LOOP
REF1
X
Y
REF2
GR3
PISP
IPI
N
Y
RESPI
% + S
VSP
PI
1876

REFDMD
SPEED FEEDBACK LOOP
REF1
X
MWI
N
Y
1087
1086
REF2
1089
RESMW
% + S
1084
1082
MW
1091

SYSTEM FOR OPERATING A STEAM TURBINE WITH IMPROVED SPEED CHANNEL FAILURE DETECTION

This is a continuation of application Ser. No. 247,597 filed Apr. 26, 1972, now abandoned.

CROSS-REFERENCE TO RELATED APPLICATIONS

1. Ser. No. 722,779, entitled "Improved System and Method for Operating a Steam Turbine and an Electric Power Generating Plant" filed by Theodore C. Giras and Manfred Birnbaum on Apr. 4, 1968, assigned to the present assignee, and continued as Ser. No. 124,993 on Mar. 16, 1971, and Ser. No. 319,115 on Dec. 29, 1972.

2. Ser. No. 408,962, entitled "System and Method for Starting, Synchronizing and Operating a Steam Turbine with Digital Computer Control" filed as a continuation of Ser. No. 247,877, abandoned, which had been filed by Theodore C. Giras and Robert Uram on Apr. 26, 1972 and assigned to the present assignee and hereby incorporated by reference; other related cases are set forth in Ser. No. 408,962.

BACKGROUND OF THE INVENTION

The present invention relates to steam turbines for electric power plants and control systems for such turbines, and more particularly to digital turbine control systems having a novel speed loop selection arrangement.

In the operation of the steam turbines, the single most important variable which must be controlled is shaft speed. During load operation, speed regulation is necessary to help the powder system maintain the line frequency. During wide range speed control, precise speed control is doubly important to bring the unit to synchronous speed, and to overcome critical speed points at which excessive vibrations may cause a turbine trip. To accomplish such demanding control objectives, it is necessary to provide high-accuracy speed input signals to the control system so that exact valve position outputs may be computed by the speed controllers.

In an installation where the control system, at least, in the automatic mode is performed by a digital computer, it is desirable to have a plurality of independent speed, signals both analog and digital form for determining the speed of the turbine. In utilizing such signals, it is also desirable to provide a means for determining the validity of such signals, with the system responding only to the valid signal.

SUMMARY OF THE INVENTION

A steam turbine for a power plant has inlet valves which are controlled by a digital electro-hydraulic control system. The digital control includes means for generating an electrical speed signal as well as an electrical signal representative of steam flow demand signal to control the operation of the steam inlet valves.

The system includes at least three independent electrical signals representative of turbine speed, and means at times to control the steam flow demand signal in accordance with a selected one of a first and second of the three signals. The means for selecting the particular signal to control the steam flow demand signal provides for comparing the three signals to determine the magnitude of difference between them. The system provides for selecting the first of the signals at times when the magnitude between the first and second is less than a predetermined amount or where the first differs from the third signal by less than predetermined amount while the second and third signals differ from each other by at least the predetermined magnitude. The second signal is selected at times when the second and third signals differ from each other by an amount less than the predetermined magnitude while the first and second signals differ from each other by at least the predetermined magnitude. Finally, the system provides for switching to the selected speed signal in response to a change in the magnitude difference.

Further, the first signal is selected from a coarse or a fine speed signal depending upon the speed of the turbine shaft.

DESCRIPTION OF THE PREFERRED EMBODIMENT

A. Power Plant

Figure 1:
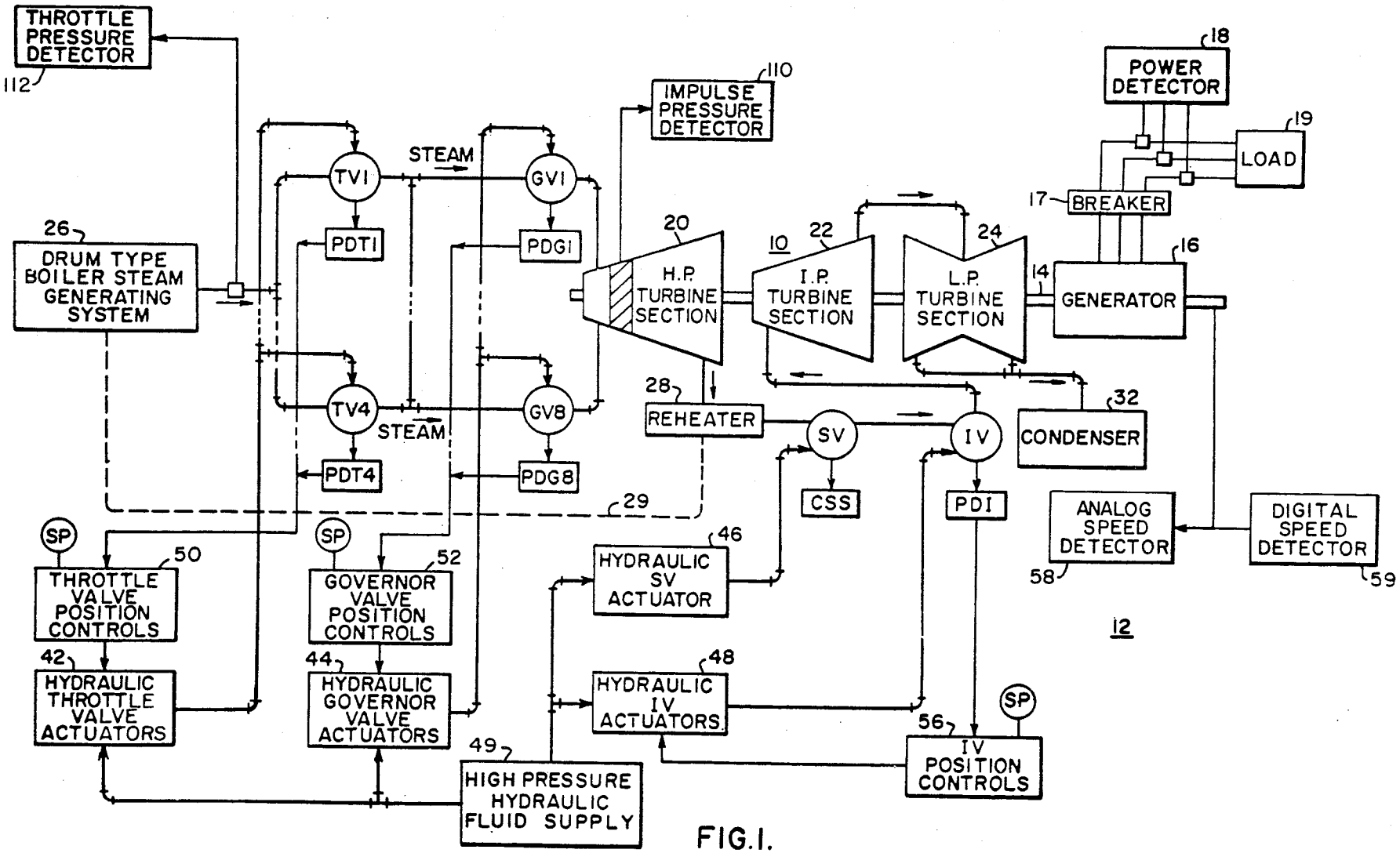
FIG. 1 shows a schematic diagram on an electric power plant including a large steam turbine and a fossile fuel fired drum type boiler and control devices which are all operable in accordance with the principles of the invention.
Figure 2:
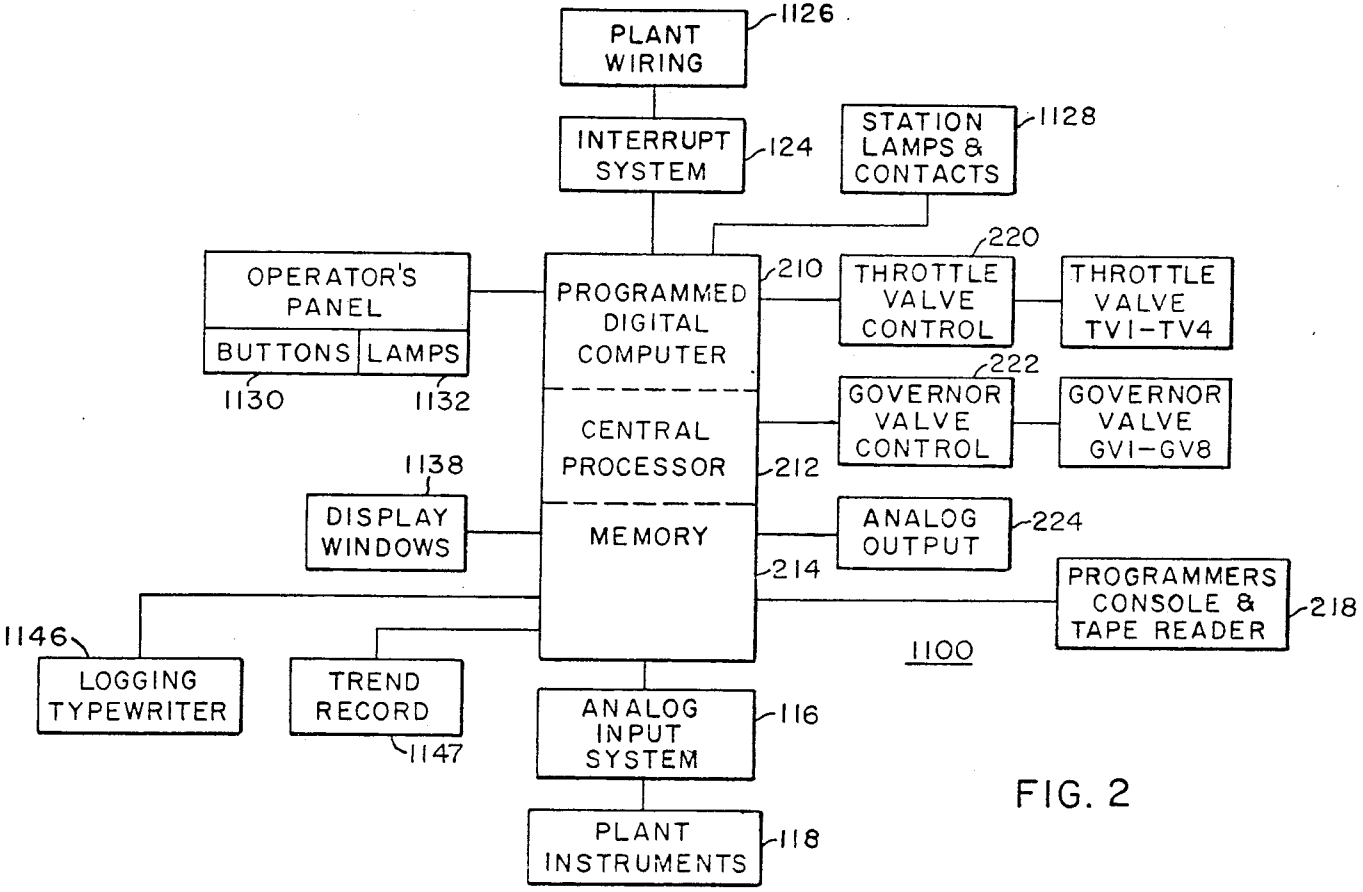
FIG. 2 shows a schematic diagram of a programmed digital computer control system operable with a steam turbine and its associated devices shown in FIG. 1 in accordance with the principles of the invention.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the aforementioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditions. Under transient electric load change conditions, system frequency may be affected, and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1–TV4. Generally, the plural inlet type and other front end turbine types such as the single ended type or the end bar lift type may involve different numbers and/or arrangements of valves.

Steam is directed from the admission steam chest to the first high pressure section expansion stage through eight governor inlet valves GV1-GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1-GV8 are typically all fully opened and steam flow control is provided by a full arc throttle valve operation. At some point in the start-up process, transfer is made from full arc throttle valve control to full arc governor valve control because of throttling energy losses and/or throttling control capability. Upon transfer the throttle valves TV1-TV4 are fully opened, and the governor valves GV1–GV8 are normally operated in the single valve mode. Subsequently, the governor valves may be individually operated in a predetermined sequence usually directed to achieving thermal balance on the rotor and reduced rotor blade stressing while producing the desired turbine speed and/or load operating level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV4 have reached the end of their control region, i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valves GV1 and GV8 are arcuately adjacent to each other.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valves SV and IV. A computer monitored high pressure fluid supply 50 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitably known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valve positions are controlled to produce control over steam flow as an intermediate variable and over turbine speed and/or load as an end control variable or variables. Actuator operation provides the steam valve positioning, and respective valve position detectors PDT1–PDT4, PDG1–PDG8 and PDI are provided to generate respective valve position feedback signals for developing position error signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect to position setpoint signals SP in developing the respective input error signals. Position controlled operation of the interceptor valving IV would typically be provided only under a reheat steam flow cutback requirement.

A speed detector 58 is provided for determining the turbine shaft speed for speed control and for frequency participation control purposes. The speed detector 58 can for example be in the form of a reluctance pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1–PDT4, PDG1–PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH — COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operate by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters as well as alarms generated by an automatic turbine startup system (ATS) which includes program system blocks 1140, 1142, 1144 (FIG. 6) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive program. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. No. 3,552,872 by T. Giras et al and U.S. Pat. No. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

Figure 3A:
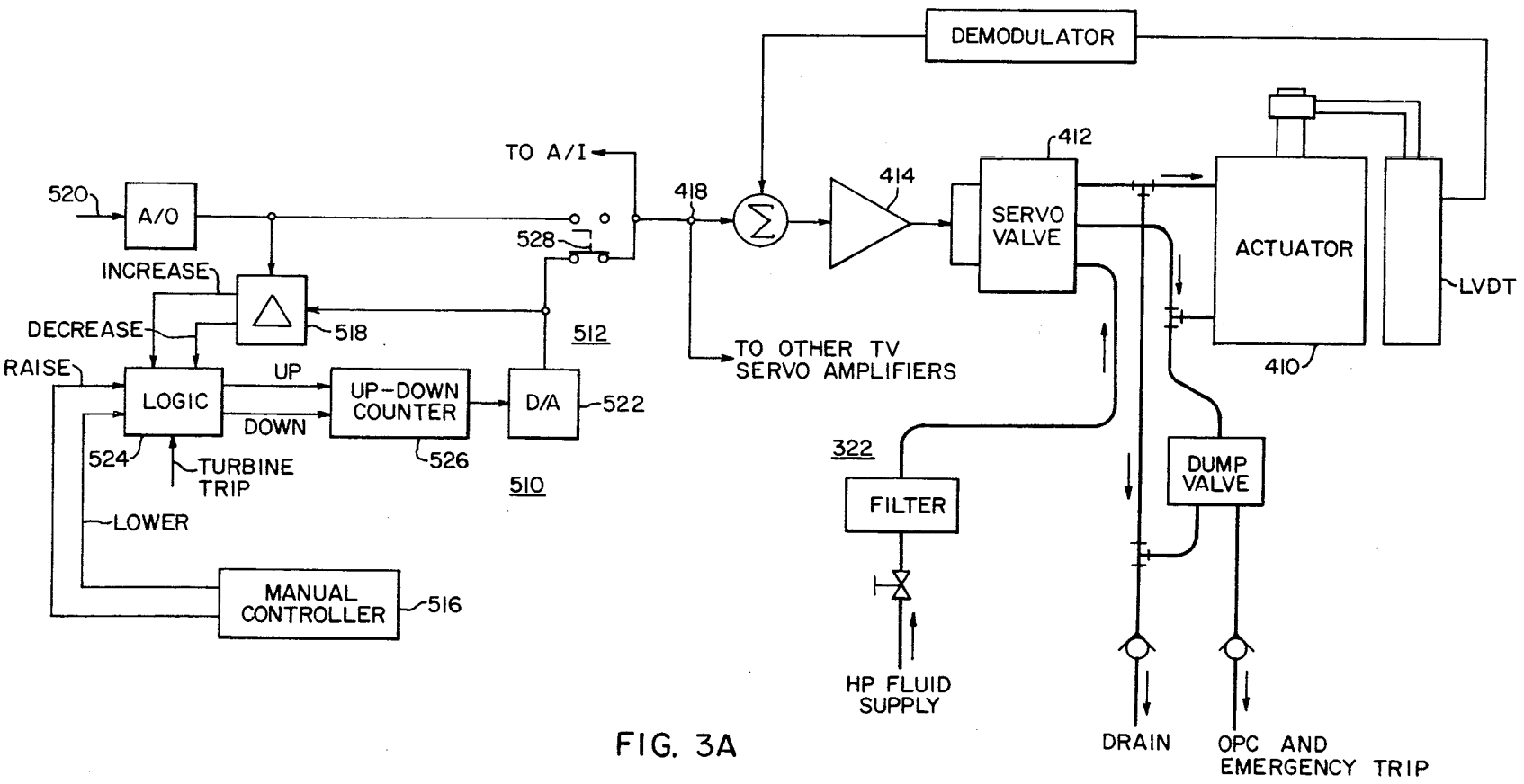
FIGS. 3A, 3B and 3C show a schematic diagram of a hybrid interface between a manual backup system and the digital computer connected with the servo system controlling the valve actuators.
Figure 3B:
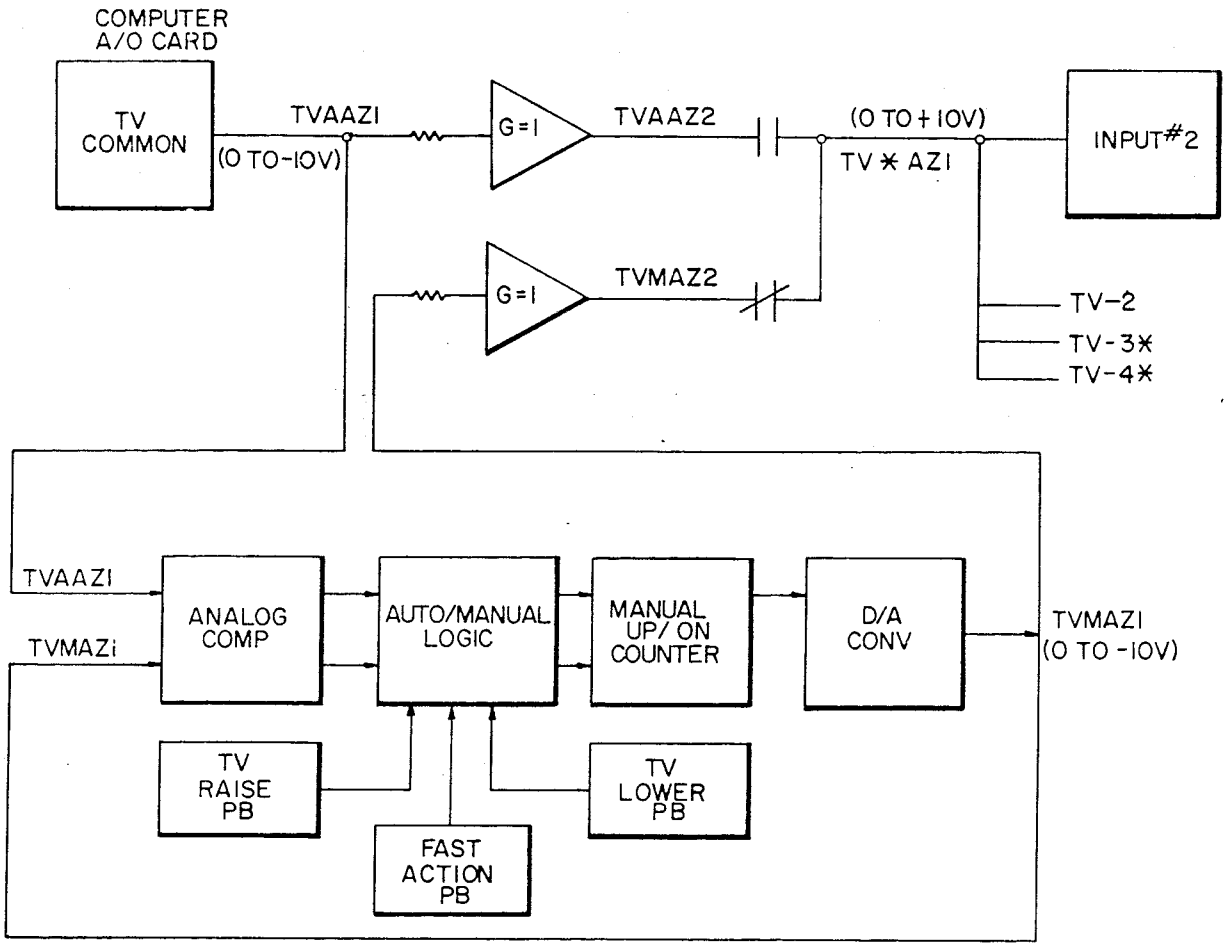
Figure 3C:
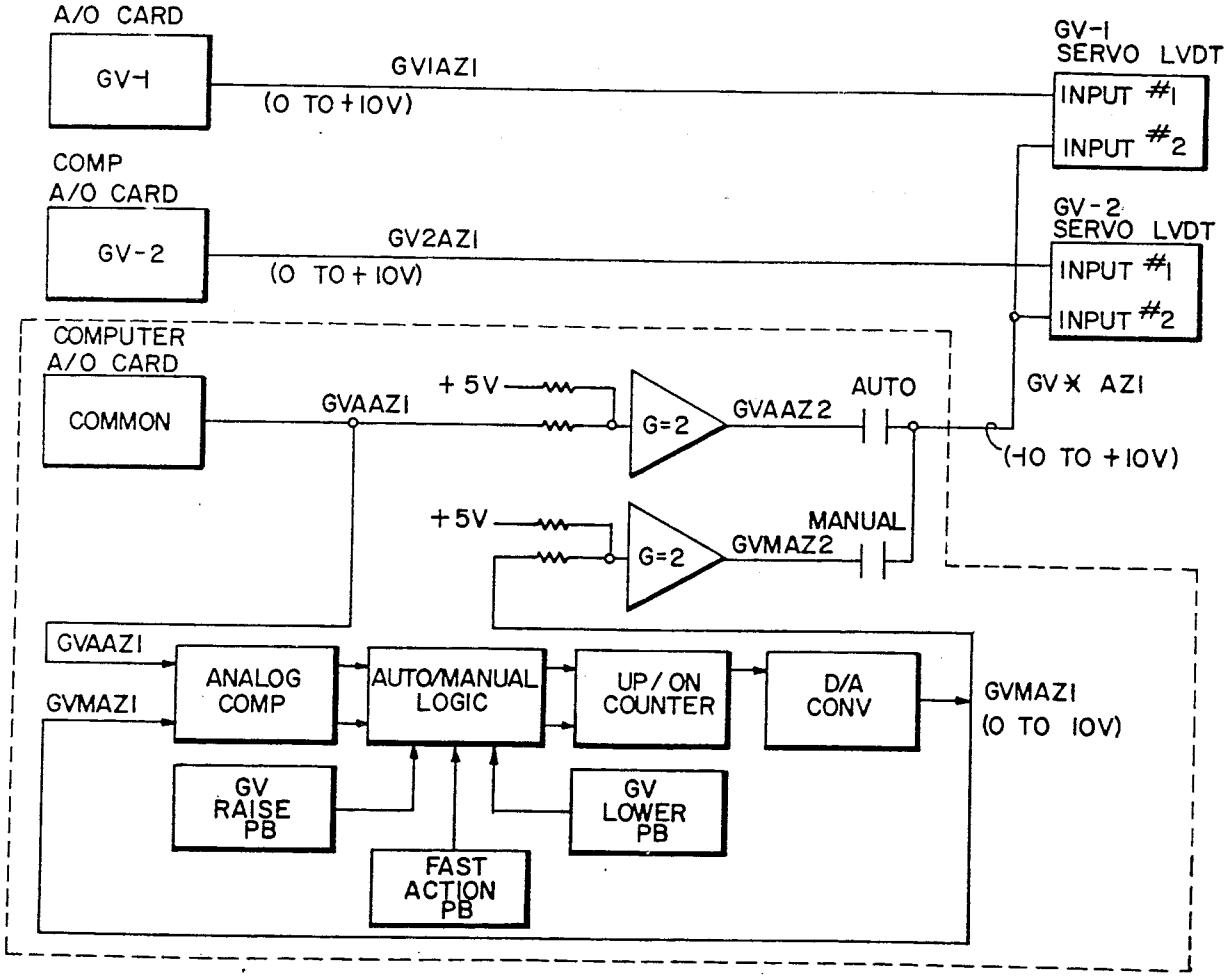

Making reference now to FIGS. 3A–3C, a hardwired digital/analog system forms a part of the DEH control system 1100 (FIG. 2). Structurally, it embraces elements which are included in the blocks 50, 52, 42 and 44 of FIG. 1 as well as additional elements. A hybrid interface 510 is included as a part of the hardwired system. The hybrid interface 510 is connected to actuator system servoamplifiers 414 for the various steam valves which is turn are connected to a manual controller 516, an overspeed protection controller, not shown, and redundant DC power supplies, not shown.

A controller shown in FIG. 3A is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 511 tracks single valve analog outputs 520 from the digital computer 210. A comparator 518 compares a signal from a digital-to-analog converter 522 of the manual system with the signal 520 from the digitsl computer 210. A signal from the comparator 518 controls a logic system 524 such that the logic system 524 runs an up-down counter 526 to the point where the output of the converter 522 is equal to the output signal 520 from the digital computer 210. Should the hardwired system 511 fail to track the signal 520 from the digital computer 210 a monitor light will flash on the operator's panel.

When the DEH control system reverts to the control of the backup manual controller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

Figure 4:
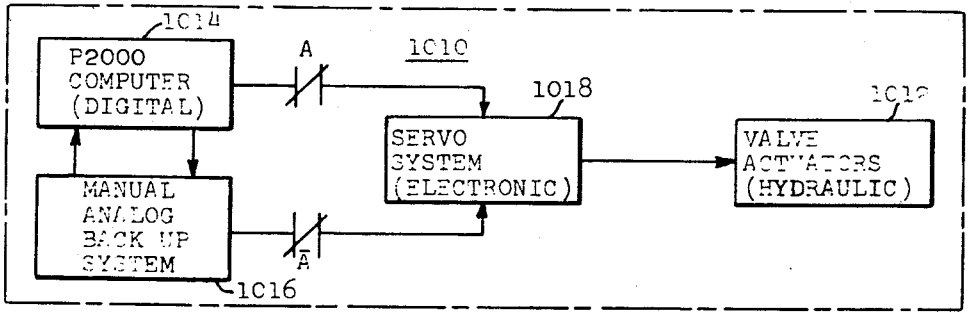
FIG. 4 shows a simplified block diagram of the digital Electro Hydraulic Control System in accordance with the principle of the invention.

With reference now to FIG. 4, an overall generalized control system of this invention is shown in block diagram form. The digital electrohydraulic (DEH) control system 1100 operates valve actuators 1012 for the turbine 10. The digital electrohydraulic control system 1100 comprises a digital computer 1014, corresponding to the digital computer 210 in FIG. 2, and it is interconnected with a hardwired analog backup control system 1016. The digital computer 1014 and the backup control system 1016 are connected to an electronic servo system 1018 corresponding to blocks 220 and 222, in FIG. 2. The digital computer control systen 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

Figure 5:
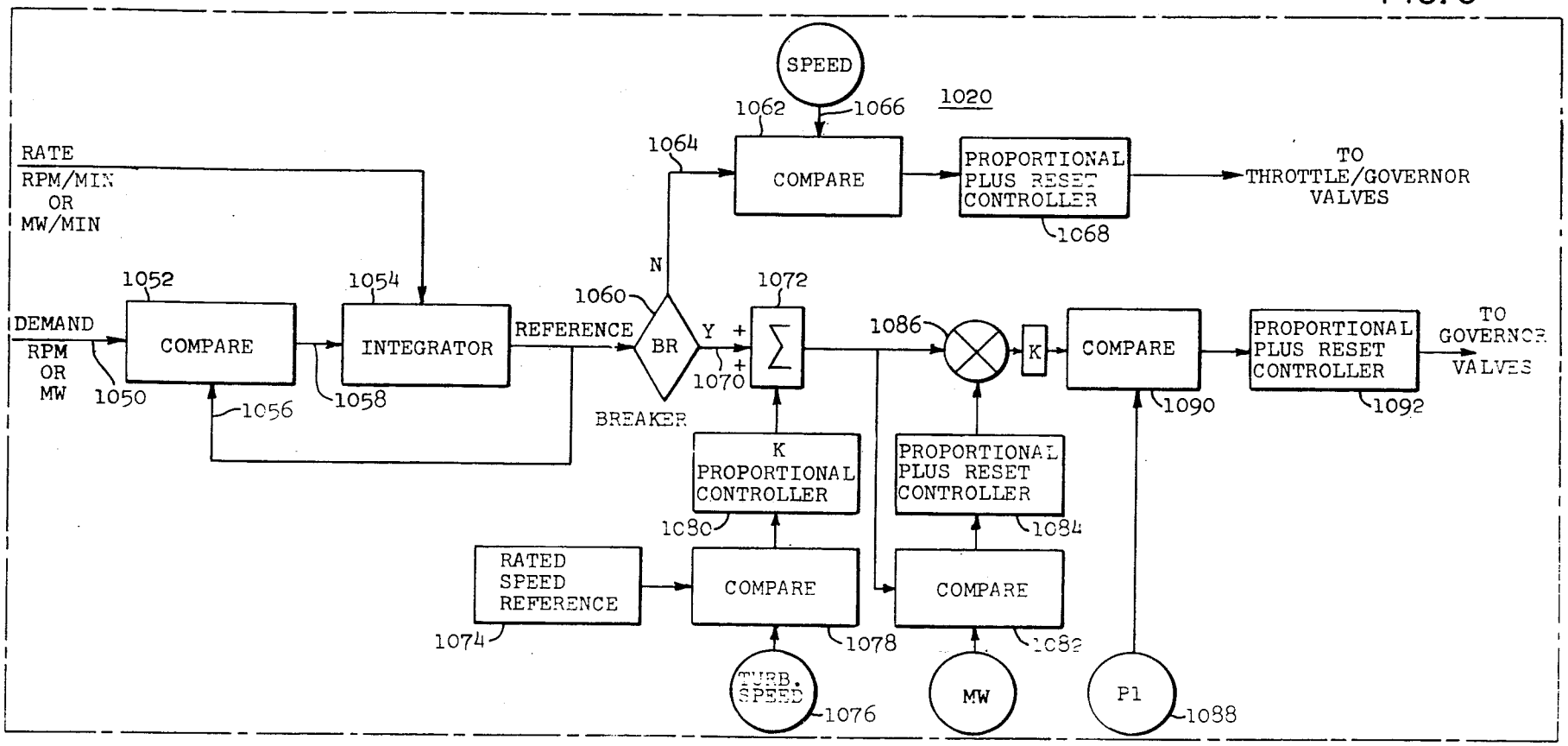
FIG. 5 shows a block diagram of a control program used in accordance with the principles of the invention.

With reference now to FIG. 5, a functional control loop diagram in its preferred form includes the CONTROL task or program 1020 which is executed in the computer 1010. Inputs representing demand and rate provide the desired turbine operating setpoints. The demand is typically either the target speed in specified revolutions per minute of the turbine systems during startup or shutdown operations or the target load in megawatts of electrical output to be produced by the generating system 16 during load operations. The demand enters the block diagram configuration of FIG. 5 at the input 1050 of a compare block 1052.

The rate input either in specified RPM per minute or specified megawatts per minute, depending upon which input is to be used in the demand function, is applied to an integrator block 1054. The rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 them makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1060 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves.

If the main generator circuit breaker 17 is closed, the CONTROL task 1020 advances from the breaker block 1060 to a summer 1072 where the REFERENCE acts as a feedforward setpoint in a combined feedfoward-feedback load control system. If the main generator circuit breaker 17 is closed, the turbine generator system 10 is being loaded by the electrical network connected thereto.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value. To provide for frequency participation, a rated speed value in box 1074 is compared in box 1078 with a two signal speed value represented by box 1076. The two signal speed system provides high turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim.

The feedforward speed compensated reference is trimmed by the megawatt feedback error multiplicatively to correct load mismatch, i.e. they are multiplied together in the feedforward turbine reference path by multiplication function 1086. Multiplication is utilized as a safety feature such that if one signal e.g. MW should fail a large value would not result which could cause an overspeed condition but instead the DEH system 1100 would switch to a manual mode.

The resulting speed compensated and megawatt trimmed reference serves as an impulse pressure setpoint in an impulse pressure controller and it is compared with a feedback inpulse chamber pressure representation from input 1088. The difference between the feedforward reference and the impulse pressure is developed by a comparator function 1090, and the error output therefrom functions in a feedback impulse pressure control loop. Thus, the impulse pressure error is applied to a proportional plus reset controller function 1092.

During load control the loop comprising in part blocks 1082 and 1084 may be switched out of service leaving the speed loop 1310 and an impulse pressure loop operative in the DEH system 1100.

Inpulse pressure responds very quickly to changes of load and steam flow and therefore provides a signal with minimum lag which smooths the output response of the turbine generator 10 because the lag dynamics and subsequent transient response is minimized. The inpulse pressure input may be switched in an out from the compare function 1090.

An alternative embodiment embracing feedforward control with impulse pressure feedback trim is applicable.

Between block 1092 and the governor valves GV1–GV8 a valve characterization function for the purpose of linearizing the response of the values is interposed. The valve characterization function described in detail in Appendix III infra herein is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller output 1092 causes positioning of the governor valves GV1–GV8 in load control to achieve the desired megawatt demand while compensation is made for speed, megawatt and impulse pressure deviations from desired setpoints.

Figure 6:
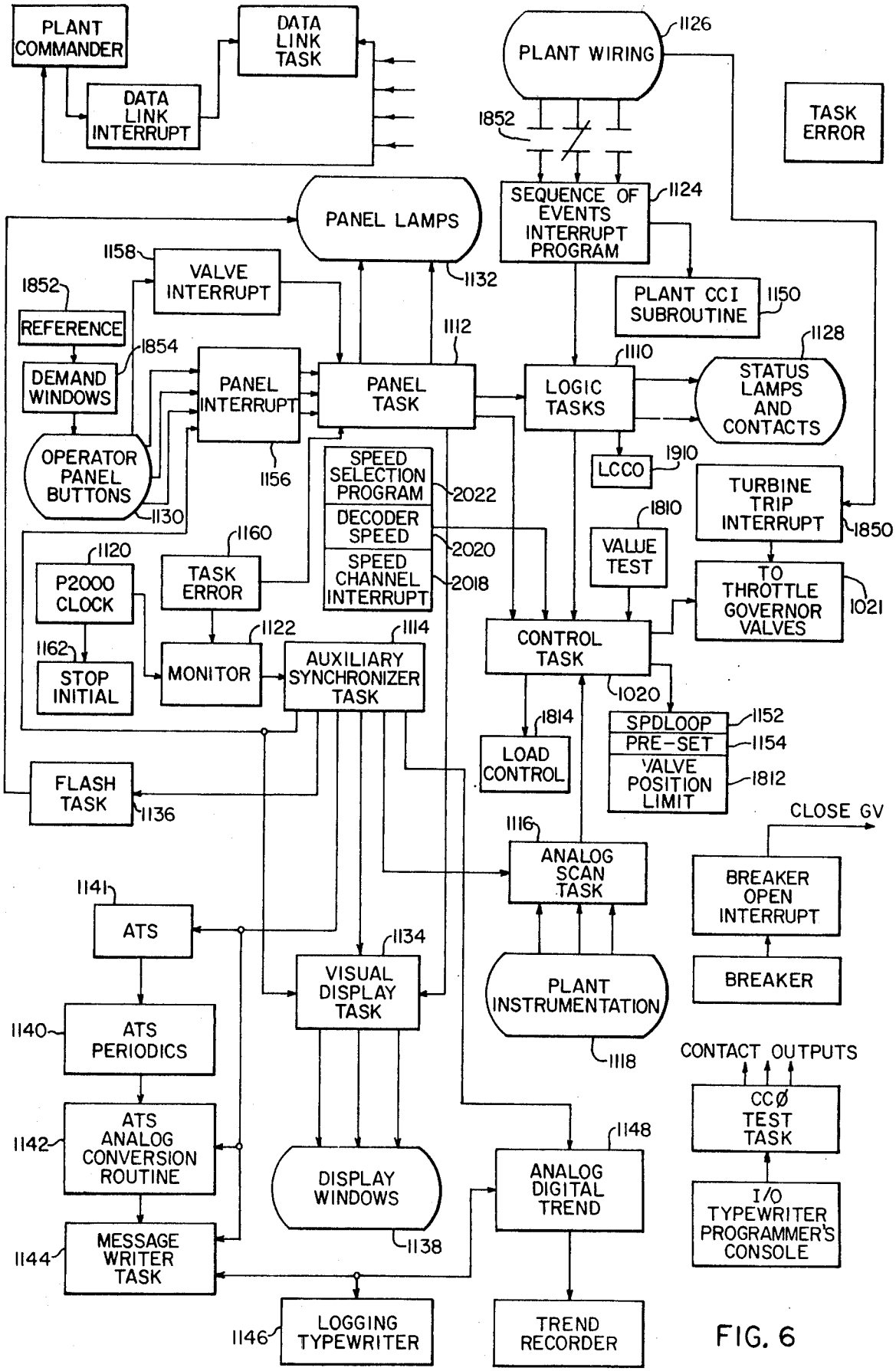
FIG. 6 shows a block diagram of the programs and subroutines of the digital Electro Hydraulic and the automatic turbine startup and monitoring program in accordance with the principles of the invention.

Making reference to FIG. 6, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through a monitor program 1112 to run the auxiliary synchronizer program 1114.

The monitor program or executive package 1122 also provides for controlling certain input/output operations of the computer and, more generally, it schedules the use of the computer to the various programs in accordance with assigned priorities. The executive package is described as including analog scan and contact closure input routines, whereas these routines are considered as programs external to the executive package.

The logic task 1110 is fed from outputs of a contact interrupt or sequence of events program 1124 which monitors contact variables in the power plant 1116. The contact parameters include those which represent breaker state, turbine auto stop, tripped/latched state interrogation data states, etc. Bids from the interrupt program 1124 are registered with and queued for execution by the executive program 1111. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 1111 the bidding of the control program 1020, the analog scan program 1116, a visual display task 1134 and a flash task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1–TV4 and governor valves GV1–GV8 in the turbine system 10, thereby controlling the megawatt load and the speed of the turbine 10.

To interface the control and logic programs efficiently, the sequence of events program 1124 normally provides for the logic task 1110 contact status updating on demand rather than periodically. The logic task 1110 computes all logical states, according to predetermined conditions and transmits this data to the control program 1020 where this information is utilized in determining the position control action for the throttle valves TV1–TV4, and the governor valves GV1–GV8. The logic task 1110 also controls the state of various lamps and relay type contact outputs in a predetermined manner.

E. DEH PROGRAMS OR TASKS

1. PRESET SUBROUTINE PROGRAM

Figure 7:
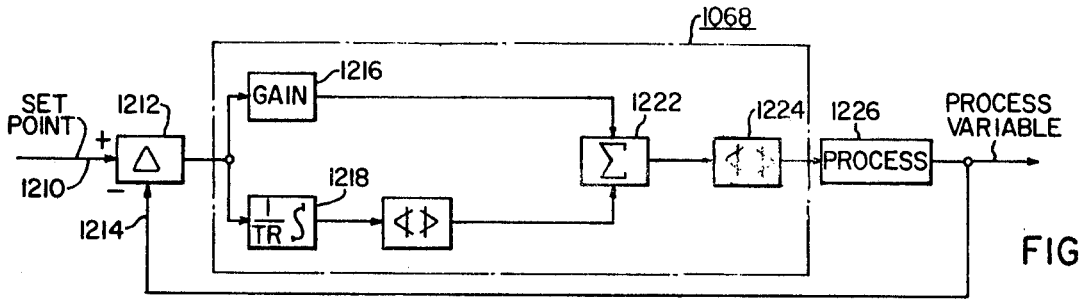
FIG. 7 shows a block diagram of a proportional-plus-reset controller program which is operable in accordance with the principles of the invention.

Making reference now to FIG. 7, a functional diagram of the proportional plus reset controller task program 1068 of FIG. 5 is shown in greater detail. The proportional plus reset controller subroutine 1068 is called by the control program 1020 of FIG. 5 when the DEH turbine control system 110 is in the speed mode of control and also when the DEH turbine control system 110 is in the load mode of control with the megawatt and impulse pressure feedback loops in service. As already indicated utilizing a proportional plus reset function during speed conrol provides very accurate control of the angular velocity of the turbine system.

The proportional plus reset controller 1068 provides an output which is composed of the sum of two parts. One part of the output is proportional to an input and the other part is an integral of the input. Therefore, instantaneous response is available as well as the capability of zero input error. A setpoint or dynamic reference from a demand source is applied to an input 1210 of a difference function 1212. The difference function 1212 compares the input and the actual controlled process value. An output from the difference function 1212 is fed to a proportional gain function 1216 and to an input of an integrator or integrating function 1218 having a rest time TR. An output from the integrator 1218 is high and low limited by the program as represented by the reset windup prevention function 1220 in order to avoid excessive integrator outputs which could occur with a reset windup.

Proportional and integral outputs from the gain function 1216 and the windup limited integrator 1218 are summed in a summing function 1222. The total output from the summing function 1222 is high and low limited by another function 1224 and fed to a process function 1226 thereby limiting the total output to a useful output range.

Figure 8:
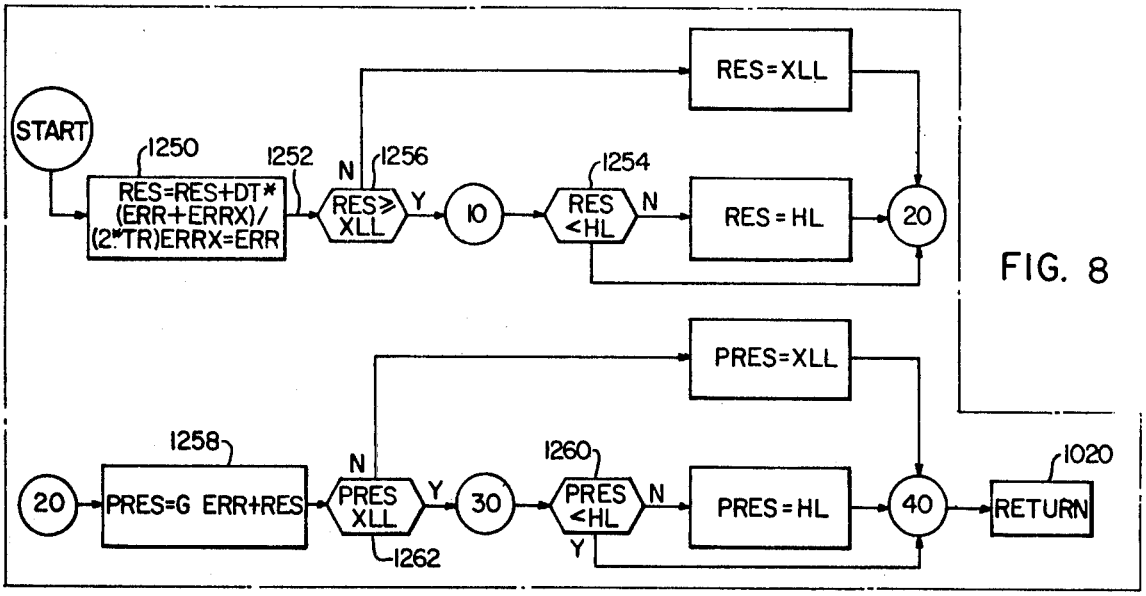
FIG. 8 shows a flow chart of th proportional-plus-reset subroutine (PRESET) which is operable in accordance with the principles of the invention.

Making reference now to FIG. 8 a pictorial representation of a flow chart for the proportional plus reset controller program is shown. In the preferred embodiment the Preset program is designed such that a call from the control program 1030 provides a list of variables necessary to evaluate the controller 1068 output. The structure of the subroutine is indicated by the Fortran statement given below.

SUBROUTINE PRESET (ERR, ERRX, G, TR, HL, XLL, RES, PRES)

The variables in the above equation are defined as follows:

| FORTRAN Variables | English Language Equivalents |
|---|---|
| ERR | The current input |
| ERRX | The last input |
| G | The controller proportional gain |
| TR | The controller reset time |
| HL | The controller high limit |
| XLL | The controller low limit |
| RES | The controller integral output |
| PRES | The controller total output |

Again making reference to FIG. 8, where standard FORTRAN notation is used, the Preset subroutine 1068 first evaluates the integral part of the controller output according to equation:

$$Y(N) = Y(N-1) + (DT/2*TR) * [X(N) + X(N-1)].$$

The subroutine 1068 next saves the current input ERR in storage location ERRX 1250 for the following call to the subroutine 1068. The controller integral output RES 1252 is then checked against the high limit 1254 and the low limit 1256 to prevent reset/windup. The proportional part of the output is computed and added to the integral part of the output integrator 1218 to form the total output PRES 1258. PRES 1258 is checked against high limit 1260 and low limit 1262 after which the proportional plus reset controller subroutine 1068 returns to the control task 1020.

As previously considered, the proportional plus reset controller subroutine 1068 is used by the control task program 1020 during three different phases of operation of the turbine system. During startup of the turbine system 10, the proportional plus reset controller subroutine program 1068 is used as a speed controller in order to regulate and hold the speed of the turbine 10 at a predetermined value or at a predetermined acceleration rate. Because of the integral function of the proportional plus reset controller subroutine program 1068 the speed of the turbine system 10 can be held to within 1 rpm. Also, in order for an operator to keep the speed of the turbine system 10 at a predetermined value, an error offset input signal typical of a purely proportional system is not required. Therefore, the reference and the controlled variable, both turbine speed in this case, will be equal. The proportional plus reset controller subroutine program 1068 is also used in the megawatt controller feedback loop and the impulse chamber pressure controller feedback loop.

Reset Integrator Algorithm To perform the mathematical function of integration in a digital computer it is desirable to use numerical techniques to approximate the exact value of the integral. In the preferred embodiment, the algorithm uses the trapezoidal rule for integration and it is simple in format, requires little computer storage and is executed very rapidly. The algorithm uses one value of input past history to achieve a high degree of accuracy.

The following algorithm is used in the computer:

$$Y(N) = Y(N-1) + (DT/2*TR)\,[X(N) + X(N-1)].$$

Definitions of the terms in this equation follow:

$(N)$ — The current instant of real time $(N-1)$ — The last instant of real time.

$DT$ — The sampling interval, or the time duration between evaluations of the integraton algorithm. In the DEH control System this is normally 1 sec.

$TR$ — The controller reset time in sec.

$X(N)$ — The current value of the input.

$X(N-1)$ — The last value of the input.

$Y(N)$ — The current value of the output.

$Y(N-1)$ — The last value of the output.

2. SPEED LOOPSUBROUTINE

Figure 9:
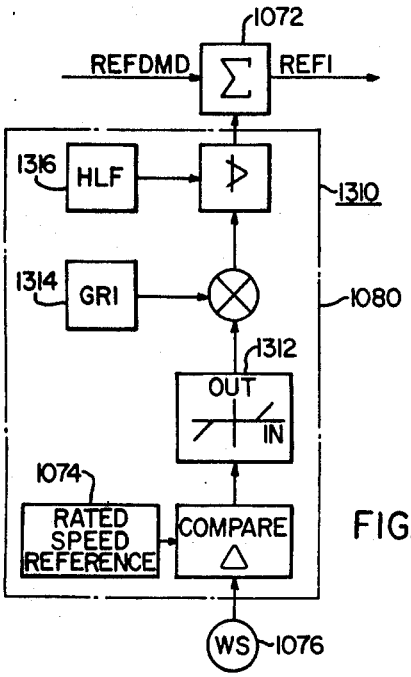
FIG. 9 shows a block diagram of a proportional controller function with dead band which is operable in accordance with the principles of the invention.

Making reference now to FIG. 9, a speed loop program 1310 which functionally is part of the arrangement shown in FIG. 5 is shown in greater detail. The speed loop (SPDLOOP) program 1310 normally computes data required in the functioning of the speed feedback loop in the load control comprising as shown in FIG. 5 the rated speed refererence 1074, the actual turbine speed 1076, the compare function 1078, the proportional controller 1080 and the summing function 1072. The speed loop subroutine 1310 is called upon to perform speed control loop functions by the control program 1020. In FIG. 9, the functioning of the proportional controller 1080 is shown in detail. The error output from the compare function 1078 is fed through a deadband function 1312. A proportionality constant (GR1) 1314 and a high limit function (HLF) 1316 are included in the computation.

The speed loop (SPDLOOP) subroutine is called by the CONTROL TASK during the load control mode and when switching occurs between actual speed signals. Subroutine form reduces the requirement for memory storage space thereby reducing the computer expense required for operation of the DEH system 1100.

The deadband function 1312 provides for bypassing small noise variations in the speed error generated by the compare function 1078 so as to prevent turbine speed changes which would otherwise occur. Systems without a deadband continuously respond to small variations which are random in nature resulting in undue stress in the turbine 10 and unnecessary, time and duty cycle consuming operation of the control system. A continuous hunting about the rate speed due to the gain of the system would occur without the deadband 1312. The speed regulation gain GR1 at 1314 is set to yeild rated megawatt output power speed correction for a predetermined turbine speed error. The high limit function HLS at 1316 provides for a maximum speed correction factor.

The turbine speed 1076 is derived from three transducers. The turbine digital speed transducer arrangement is that disclosed in greater element and system implementation detail in the aforementioned Reuther application Ser. No. 412,513. Briefly, in the preferred embodiment for determining the speed of the turbine, the system comprises three independent speed signals. These speed signals consist of a very accurate digital signal generated by special electronic circuitry from a magnetic pickup, an accurate analog signal generated by a second independent magnetic pickup, and a supervisory analog instrument signal from a third independent pickup. The DEH system compares these signals and through logical decisions selects the proper signal to use for speed control or speed compensated load control. This selection process switches the signal used by the DEH control system 1100 from the digital channel signal to the accurate analog channel signal or vice versa under predetermined dynamic conditions. In order to hold the governor valves at a fixed position during this speed signal switching the control program 1020 uses the speed loop subroutine 1310 and performs a computation to maintain a bumpless speed signal transfer.

Figure 10:
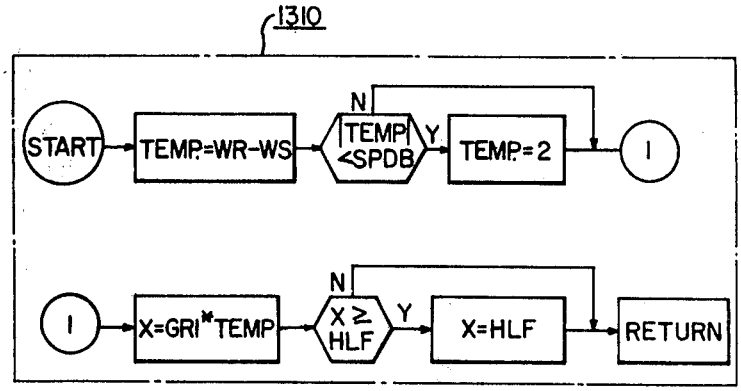
FIG. 10 shows a flow chart of a speed loop (SPDLOOP) subroutine which is operable in accordance with the principles of the invention.

Making reference to FIG. 10, the speed loop (SPDLOOP) subroutine flow chart 1310 is shown in greater detail. Two FORTRAN statements signify the operations of the speed loop subroutine program flow chart 1310. These statements are:

CALL SPDLOOP

REF1 = REFDMD + X

Variables in the flow chart 1310 are defined as follows:

| FORTRAN VARIABLES | ENGLISH LANGUAGE EQUIVALENT |
|---|---|
| REFMD | Load reference |
| WR | The turbine rated speed |
| REF1 | Corrected load reference |
| WS | The actual turbine speed |
| TEMP | Temporary storage location variable |
| SPDB | The speed deadband |
| GR1 | The speed regulation gain (normally set to yield rated megawatt speed correction for a 180 rpm speed error) |
| X | Speed correction factor |
| HLF | The high limit function |

OPERATOR'S PANEL PROGRAM

Figure 11:
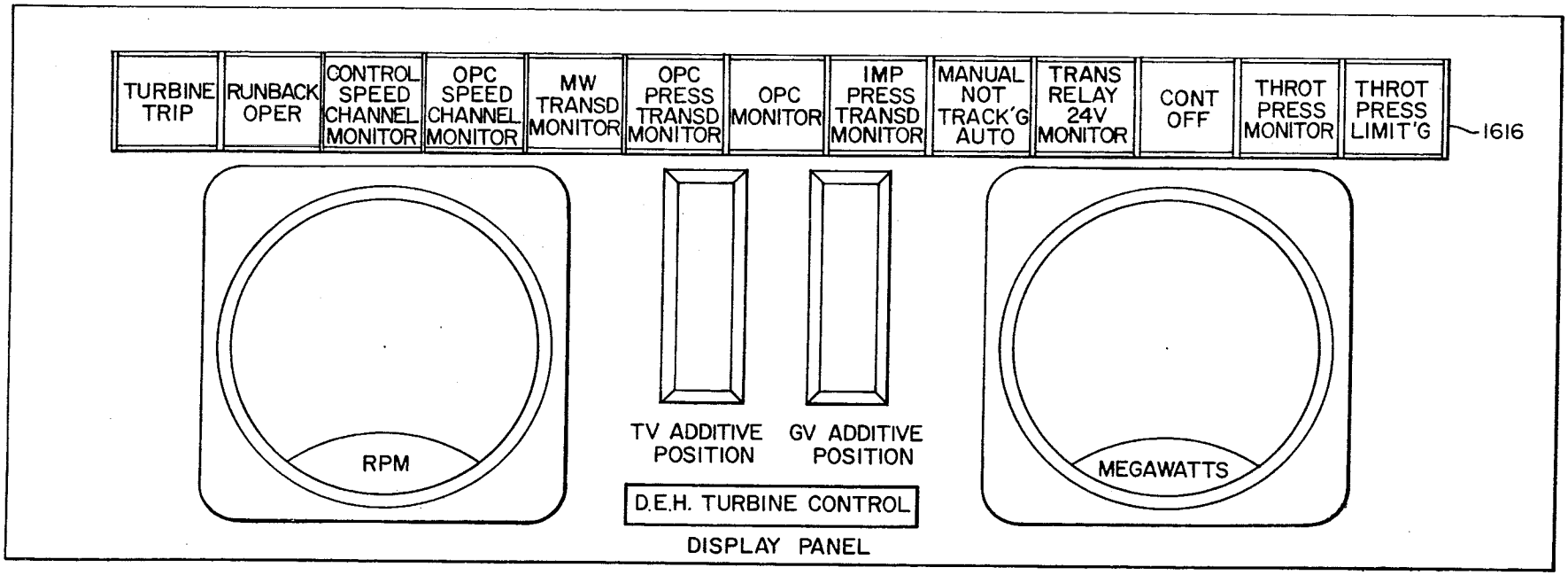
FIG. 11. shows a view of a part of an operator's control panel which is operable in accordance with the principles of the invention.
Figure 12:
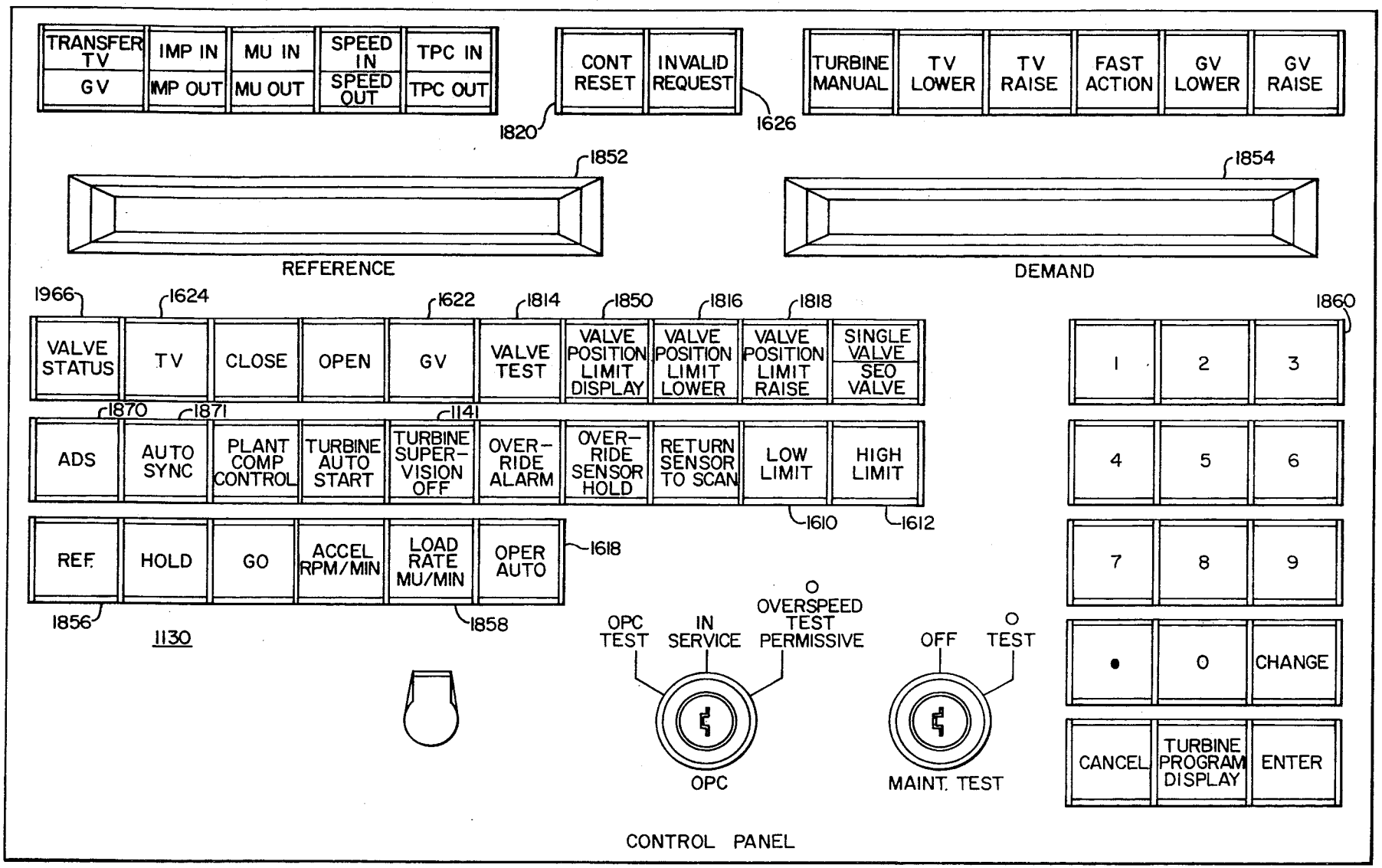
FIG. 12 shows a view of a part of the operator's control panel which is operable in accordance with the principles of the invention.
Figure 13:
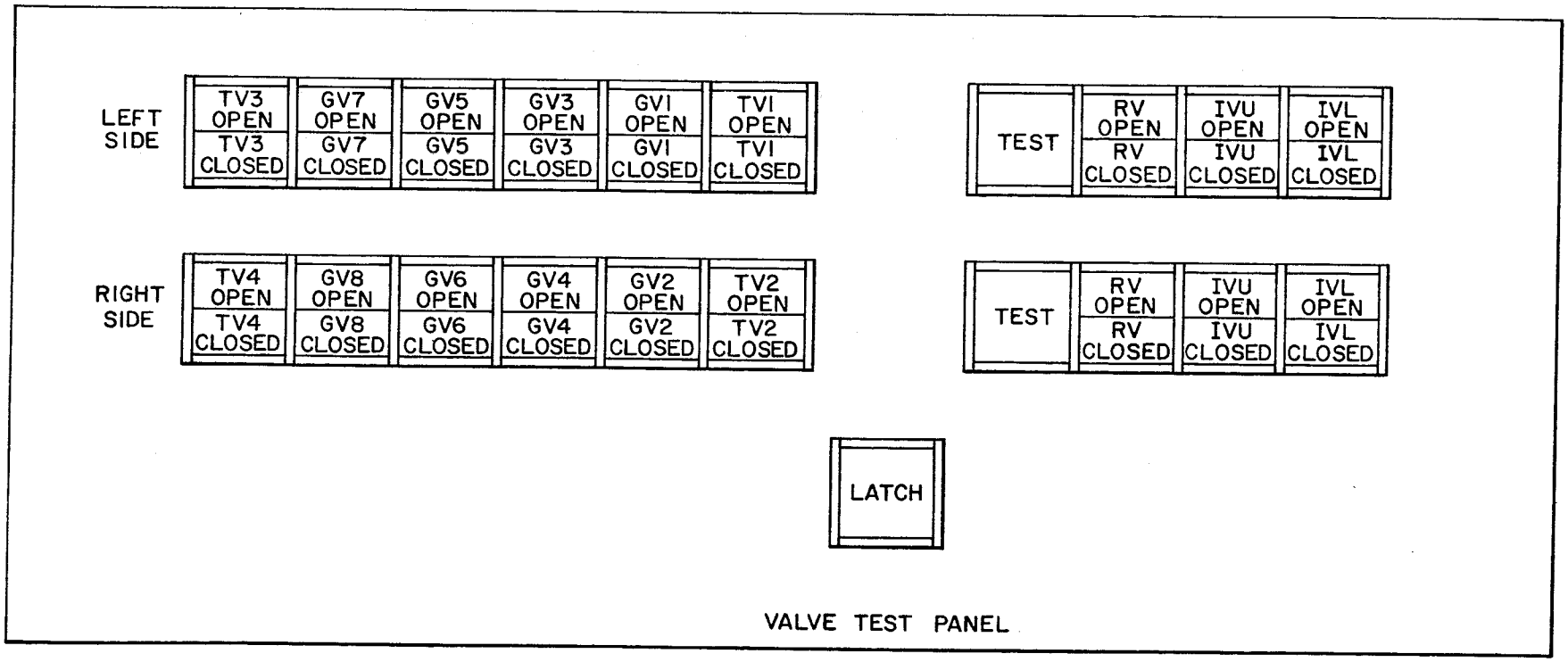
FIG. 13 shows a view of a portion of the operator's control panel which is operable in accordance with the principles of the invention.

Referring now to FIGS. 11, 12 and 13, the control panel 1130 for the digital electrohydraulic system 1100 is shown in detail. Specified functions have control panel buttons which flash in order to attract the attention of an operator.

The control of the operation of the DEH control system 1100 is greatly facilitated for the operator by the novel layout of the operator's panel 1130, the flashing and warning capabilities thereof, and the interface provided with the turbine control and monitor functions through the pushbutton switches. In addition, simulated turbine operation is provided by the DEH system for operator training or other purposes through the operation of the appropriate panel switches during turbine down time.

In addition the layout of the panel 1130 of FIGS. 11, 12 and 13 is unique and very efficient from operation and operator interface considerations. The control of the DEH system 1100 by the buttons of the panel 1130 and the software programs thereto provides improved operation of the computer 210 and turbine generator 10.

Softward details of the panel 1130 interface are available in the appendices 3, 4, 5 and 6.

4. PANEL INTERRUPT PROGRAM

Figure 14:
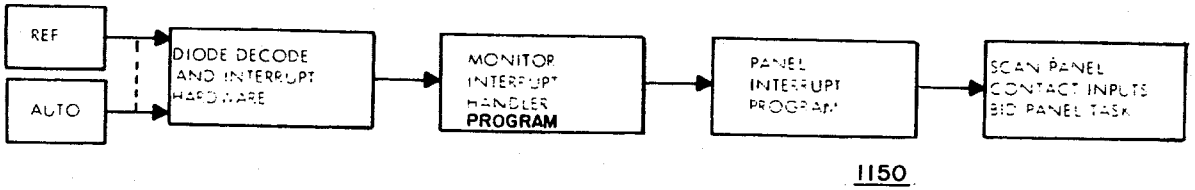
FIG. 14 is a block diagram of a panel interrupt program which is operable in accordance with the principles of the invention.
Figure 15:
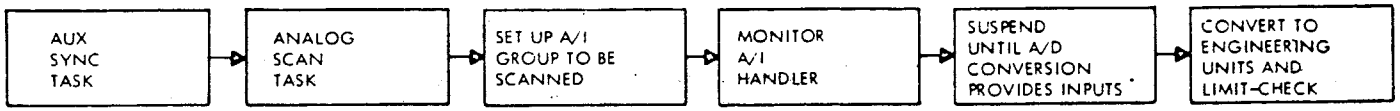
FIG. 15 is a block diagram of an analog scan system which is operable in accordance with the principles of the invention.

A block diagram of the panel interrupt program 1156 is shown in FIG. 14.

5. ANALOG SCAN PROGRAM

The analog scan program 1116, shown in FIG. 6 periodically scans all analog inputs to the DEH system 1110 for control and monitoring purposes. The function of the analog scan program 1116 is performed in two parts. The first part of the analog scan program 1116 comprises the scanning of a first group of analog inputs. Values of scanned inputs are converted to engineering units and the values are checked against predetermined limits as required for computations in the DEH computer.

The second part of the function of the analog scan program 1116 comprises the scanning of the analog inputs required for the automatic turbine startup program as shown in FIG. 6. The automatic turbine startup program is shown in FIG. 6 as the ATS periodic program 1140, the ATS analog conversion routine 1142 and the ATS message writer program 1144.

6. LOGIC TASK

Figure 16:
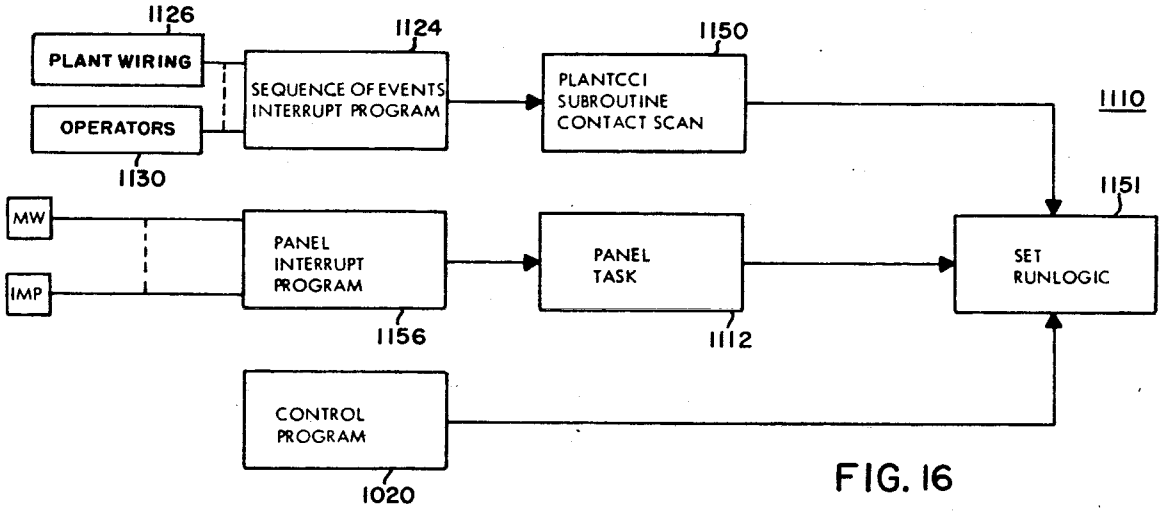
FIG. 16 is a block diagram of conditions which cause initiation of a logic program which is operable in accordance with the principles of the invention.
Figure 17:
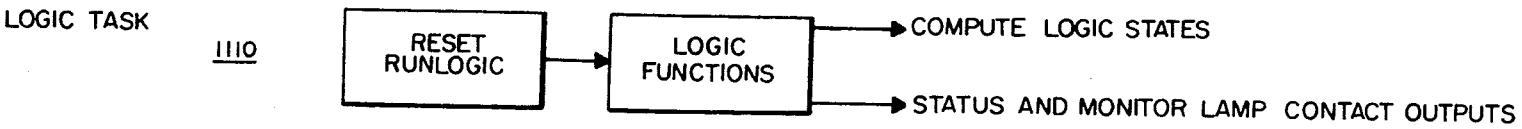
FIG. 17 is a simplified block diagram of a portion of the logic function which is operable in accordance with the principles of the invention.
Figure 18:
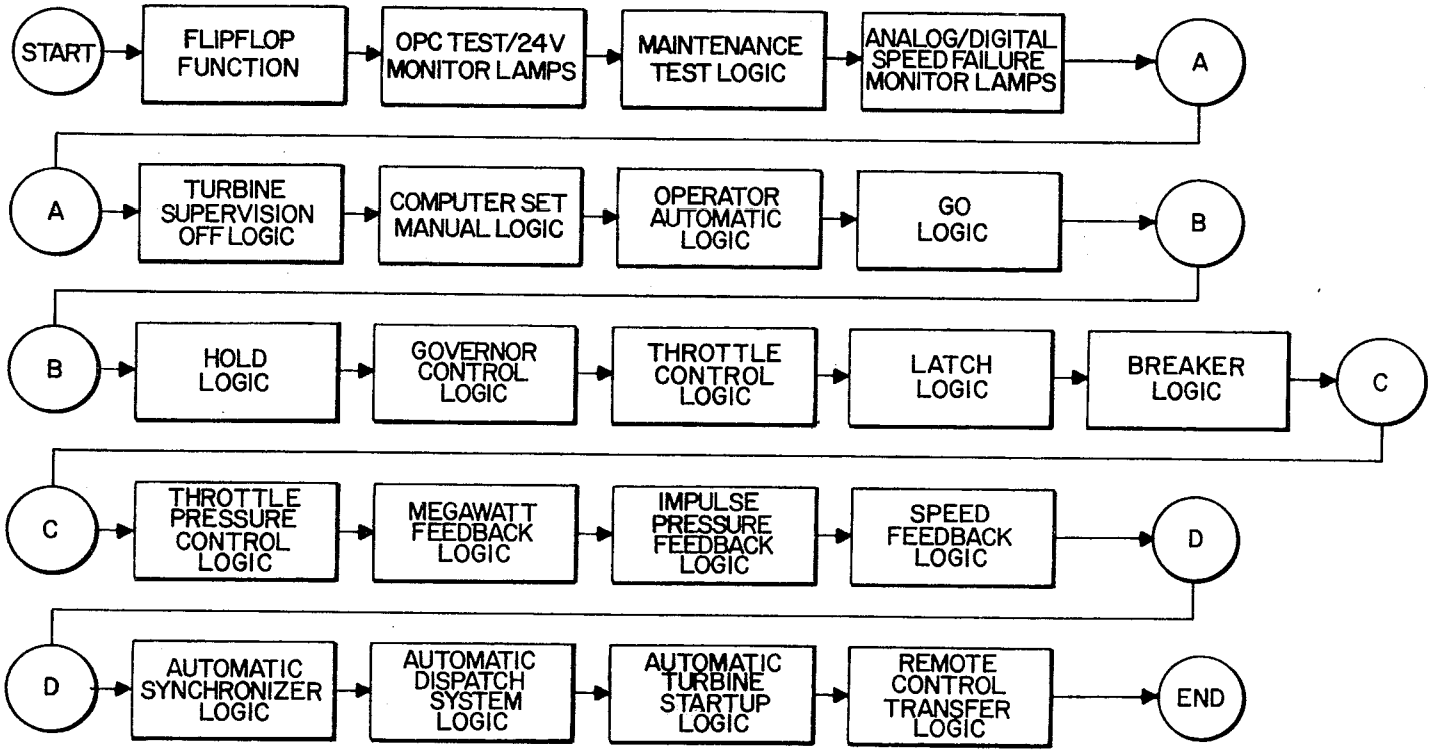
FIG. 18 is a block diagram of the logic program which is operable in accordance with the principles of the invention.

Referring now to FIG. 16, a block diagram representing the operation of the logic task 1110 is shown. A contact input from the plant wiring 1126 triggers the sequence of events or interrupt program 1124 which calls upon the plant contact closure input subroutine 1150 which in turn requests that the logic program 1110 be executed by the setting of a flag called RUN-LOGIC 1151 in the logic program 1110. The logic program 1110 is also run by the panel interrupt program 1156 which calls upon the panel task program 1112 to run the logic program 1110 in response to panel button operations. The control task program 1020 in performing its various computations and decisions will request the logic program 1110 to run in order to update conditions in the control system. In FIG. 17, the functioning of the logic program 1110 is shown. FIG. 18 shows a more explicit block diagram of the logic program 1110.

The logic program 1110 controls a series of tests which determine the readiness and operability of the DEH system 1100. One of these tests is that for the overspeed protection controller which is part of the analog backup portion of the hardwired system 1016 shown in FIG. 4. Generally, the logic program 1110 is structured from a plurality of subroutines which provide the varying logic functions for other programs in the DEH program system, and the various logic subroutines are all sequentially executed each time the logic program is run.

COMPUTER SET MANUAL LOGIC

When the DEH system is in automatic control, it is possible for certain conditions to occur which require transfer to manual operator control. One of these is the case in which the maintenance test switch is moved to the test position. Even though a wired connection places the control in manual operation, the DEH LOGIC program sets a contact output requesting transfer to manual as a backup. The second situation occurs when the turbine is on automatic speed control and all speed input signals fail, as determined by the speed selection program in the CONTROL task. This speed channel failure will also require transfer to manual operation by a contact output from this LOGIC task.

STM is the logic variable to switch to turbine manual control, and is set by the maintenance test contact input (OPRT) or the speed channel failure variable (SPFT) while on speed control (i.e. the main breaker (BR) is not set). A call to the LCCO subroutine is then made.

BREAKER LOGIC

Referring again to FIG. 1 upon synchronization of the turbine system 10 with a power grid, not shown, the governor valves GV1 through GV8 must allow sufficient steam to flow through the turbine system 10 to overcome turbine system losses. Otherwise, upon synchronization of the generator 16 with other generators in the power grid by closing the breakers 17, the turbine system 10 would as already indicated have a tendency to motor. The DEH control system 1100, in order to prevent motoring and subsequent damage to the low pressure turbine section 24, automatically opens the governor valves GV1 through GV8 such that a predetermined load is picked up by the generator 16 upon synchronization.

Figure 19:
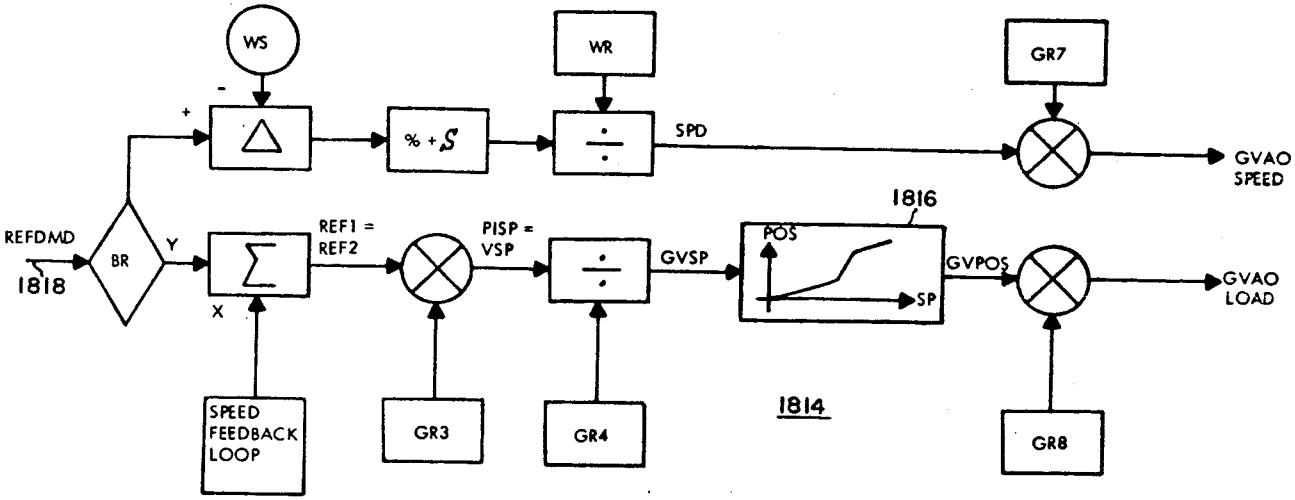
FIG. 19 is a block diagram of a load control system which is operable in accordance with the principles of the invention.
Figure 20:
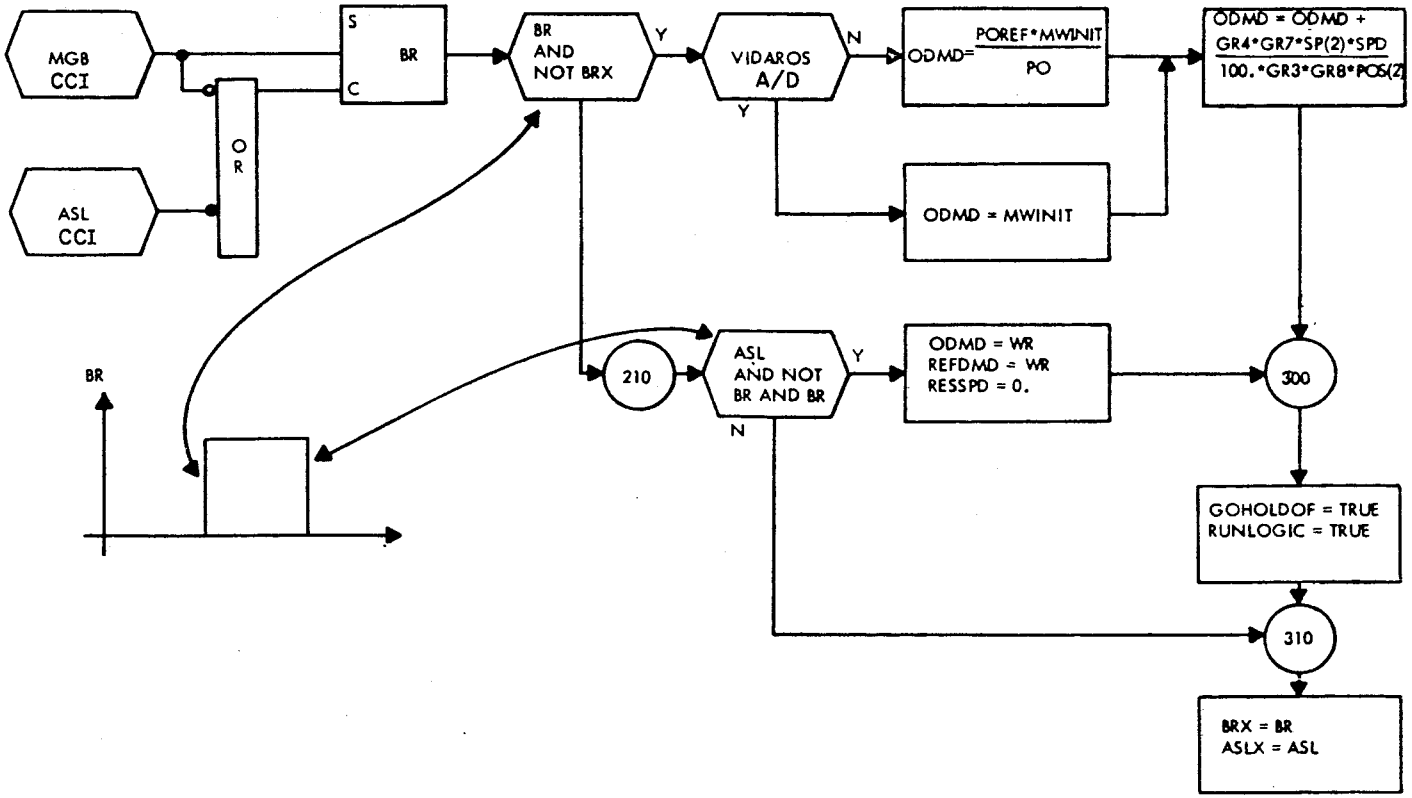
FIG. 20 is a flow chart of a breaker logic program which is operable in accordance with the principles of the invention.

The value of the initial megawatt pickup is defined as MWINIT upon synchronization is entered from the keyboard 1860 in FIG. 12 and is typically set at about 5% of the rating of the turbine-generator 10. In the load control system 1814, as shown in FIG. 19, the actual megawatt pickup is modified by a factor which is the ratio of the rated throttle pressure to the existing throttle pressure at synchronization. This factor is utilized by the DEH system 1100 in maintaining approximately the same initial megawatt load pickup whether the turbine system 10 is synchronized at rated throttle pressure or at some lower or even higher throttle pressure.

MEGAWATT FEEDBACK LOGIC

Figures 21, 22:
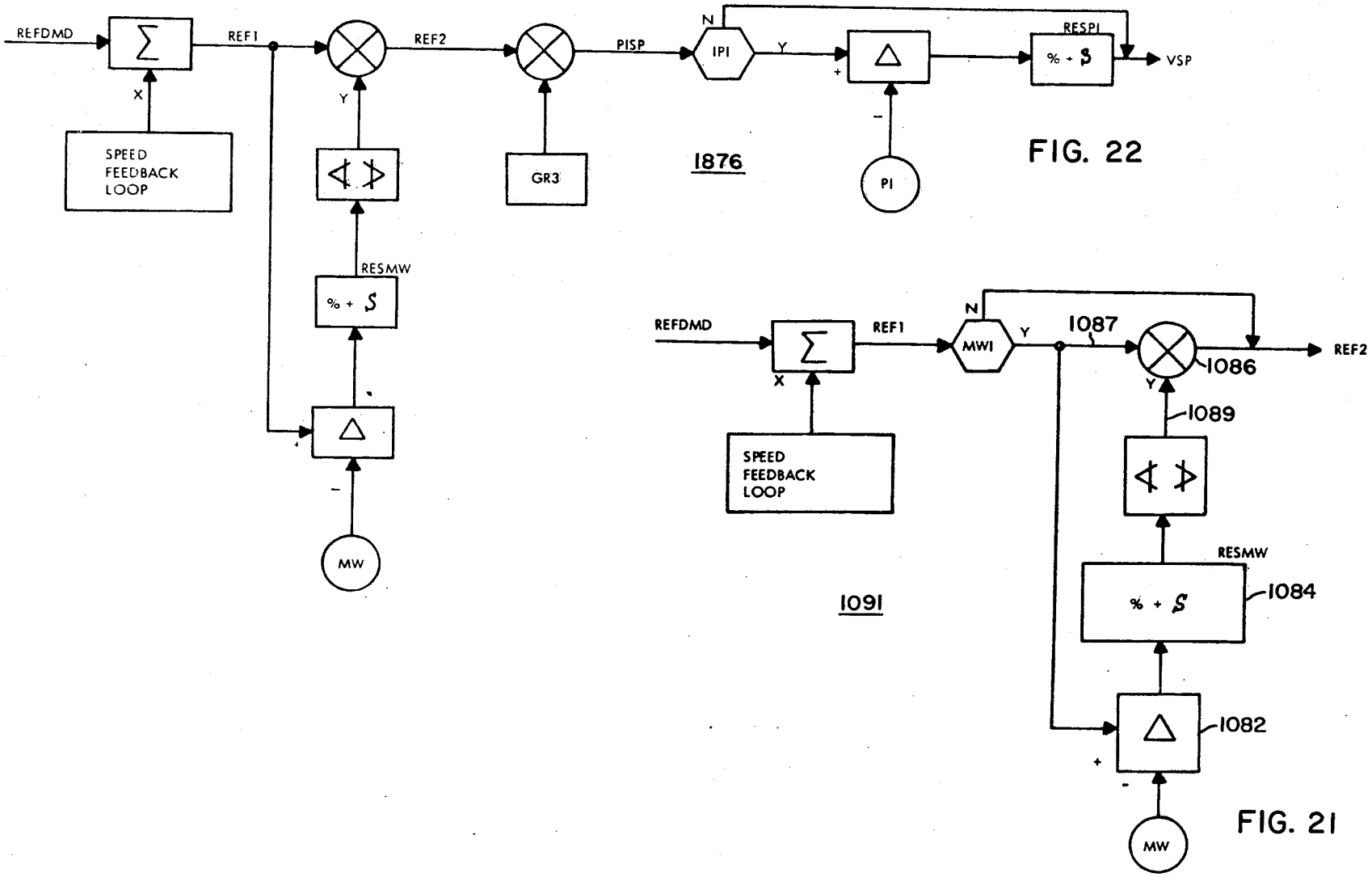
FIG. 21 is a block diagram of a megawatt feedback loop subroutine which is operable in accordance with the principles of the invention.
FIG. 22 is a block diagram of an impulse pressure loop with megawatt loop in service which is operable in accordance with the principles of the invention.

Referring to FIG. 21, a block diagram of the megawatt feedback loop is shown in greater detail than in FIG. 5. It should be noted that the speed compensated reference 1087, at the input of multiplication function 1086, is multiplied by the megawatt compensation 1089. The multiplication of the signals instead of a differencing provides an additional safety feature since the loss of either of the signals 1087 or 1089 will produce a zero output rather than a runaway condition.

IMPULSE PRESSURE FEEDBACK LOGIC

The impulse pressure feedback logic is shown in greater detail in FIG. 22. With a digital computer, bumpless transfer is achieved without the use of elaborate external circuitry because of the digital computational nature of the machine. A value can be computed instantaneously and inserted in the integrator 1218 of the proportional plus reset controller subroutine 1068 as shown in FIG. 7. In the preferred embodiment of the Digital Electro-Hydraulic control system 1100, the proportional plus reset controller 1168 is utilized by the following functions: the megawatt feedback loop 1091, the impulse pressure feedback loop 1816 and the speed feedback loop made up of the rated speed reference 1074, the compare function 1076 and the actual turbine speed function 1076.

SYNCHRONIZER LOGIC

The turbine 10 operates in accordance with actions generated by the DEH control program in response to the synchronizer signals.

7. PANEL TASK

Figure 23:
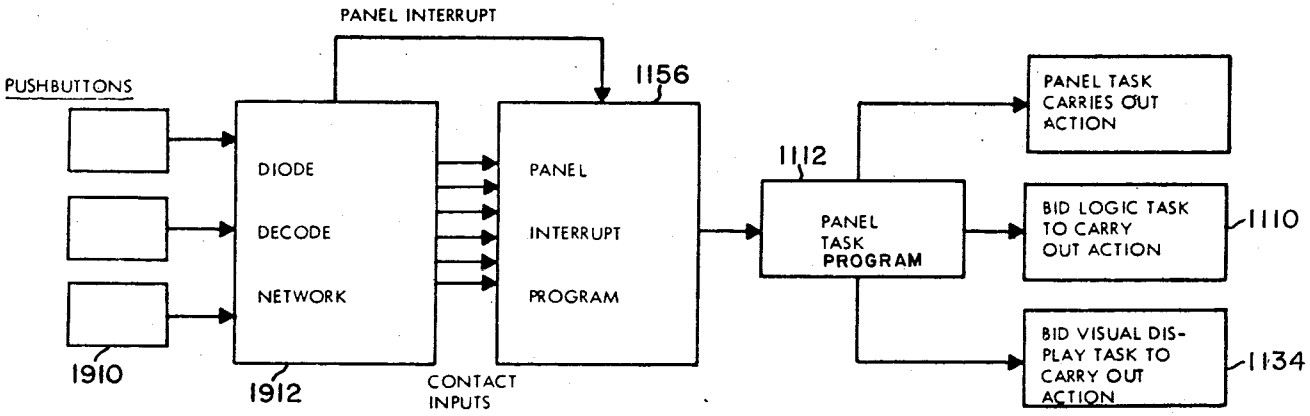
FIG. 23 is a block diagram showing a panel task interaction function which is operable in accordance with the principles of the invention.
Figure 24:
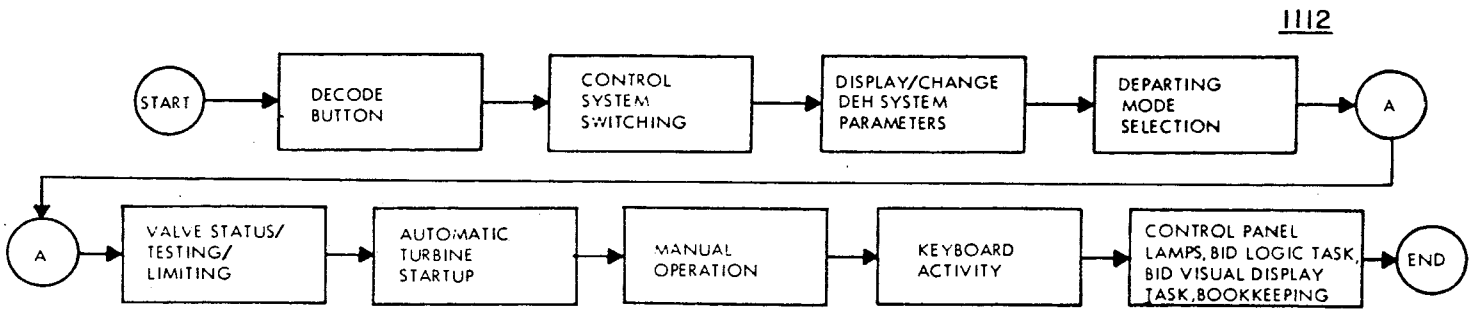
FIG. 24 is a block diagram of a panel program which is operable in accordance with the principles of the invention.

The panel task 1112 responds to the buttons pressed on the operator's panel 1130 by an operator of the DEH control system 1100. The control panel 1130 is shown in FIGS. 11 and 12. Referring now to FIGS. 23 and 24, the interactions of the panel task 1112 are shown in greater detail. Pushbuttons 1110 are decoded in a diode decoding network 1912 which generates contact inputs to activate the panel interrupt program 1156. The panel interrupt program scans the contact inputs and bids the panel task 1112 whereby the pressed button is decoded and either the panel task 1112 carries out the desired action or the logic task 1110 is bid or the visual display task 1134 is called to carry out the desired command.

8. CONTROL PROGRAM

Automatic control of turbine speed and load requires a complex, interacting feedback control system capable of compensating for dynamic conditions in the power system, the boiler and the turbine-generator. Impulse chamber pressure and shaft speed from the turbine, megawatts from the generator, and throttle pressure from the boiler are used in the controlled operation of the turbine.

In addition to the primary features discussed above, the DEH system also contains provisions for high and low load limits, valve position limit, and throttle pressure limit; each of these can be adjusted from the Operator's Panel. A number of auxiliary functions are also available which improve the overall turbine performance and the capabilities of the DEH system. Brief descriptions of these follow:

1. Valve position limit adjustment from the Operator's Panel.
2. Valve testing from the Operator's Panel.
3. Speed signal selection from alternate independent sources.
4. Automatic instantaneous, and bumpless operating-mode selection from the Operator's Panel.
5. A continuous valve position monitor and contingency-alert function for the operator during automatic control.
6. A digital simulation and training feature which allows use of the Operator's Panel and most of the DEH system at any time on manual control, without affecting the turbine output or valve position. This powerful aid is used for operator and engineer training, simulation studies, control system tuning or adjustment, and for demonstration purposes.

In order to achieve these objectives, the CONTROL task is provided with analog inputs representing the various important quantities to be controlled, and also is supplied with contact inputs and system logical states.

Figure 25:
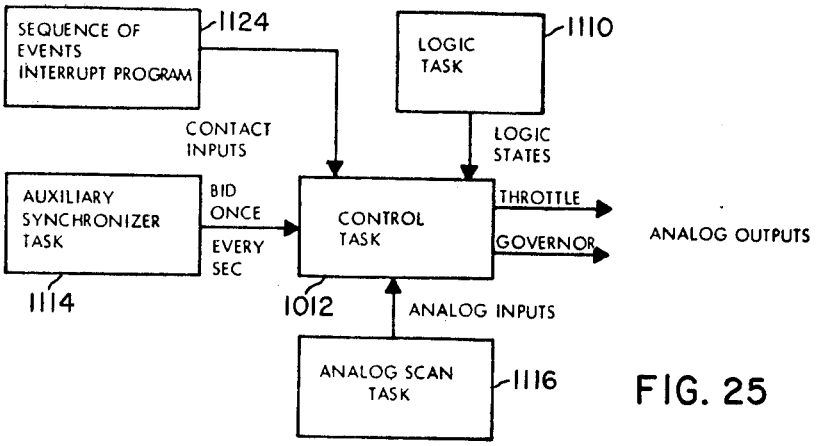
FIG. 25 is a block diagram showing a control task interface which is operable in accordance with the principles of the invention.
Figure 26:
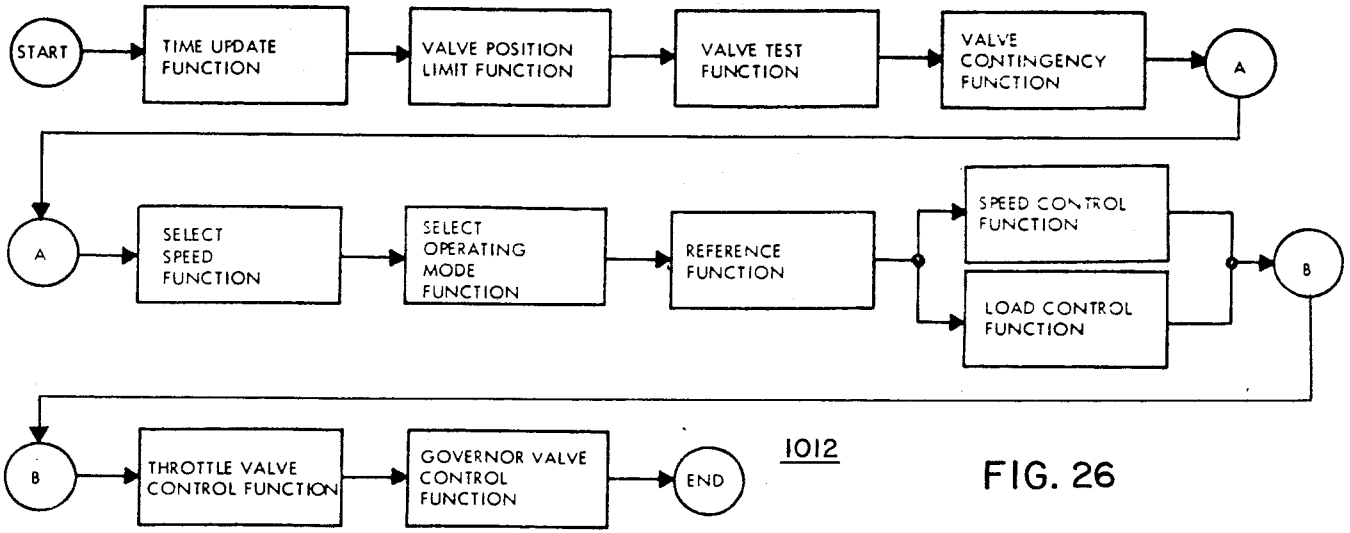
FIG. 26 is a block diagram showing a control program which is operable in accordance with the principles of the invention.

The control program 1012 related programs are shown in greater detail in FIG. 25. In the computer program system, the control program 1012 is interconnected with the analog scan program 1116, the auxiliary sync program 1114, the sequence of events interrupt program 1124 and the logic task 1110. FIG. 26 shows a block diagram of the control program 1012. The control program 1012 accepts data from the analog scan program 1116, the sequence of events interrupt program 1124 and is controlled in certain respects by the logic program 1110 and the auxiliary synchronizing program 1114. The control program 1012, upon receiving appropriate inputs, computes the throttle valve TV1–TV4 and the governor valve GV1–GV8 ouputs needed to satisfy speed or load demand.

The control program 1012 of the DEH control system 1100 functions, in the preferred embodiment, under three modes of DEH system control. The modes are manual, where the valves GV1–GV8 and TV1–TV4 are positioned manually through the hardwired control system and the DEH control computer tracks in preparation for an automatic mode of control. The second mode of control is the operator automatic mode, where the valves GV1–GV8 and TV1–TV4 are positioned automatically by the DEH computer in response to a demand signal entered from the keyboard 1130, of FIG. 12. The third mode of control is remote automatic mode, where the valves GV1–GV8 and TV1–TV4 are positioned automatically as in the operator automatic mode but use the automatic turbine startup program 1141 or an automatic synchronizer or an automatic dispatch system for setting the demand value.

SPEED SELECTOR FUNCTION

The DEH Control System has three independent speed signals available; these are used to achieve the precision required in speed control. The first of these (which is called the digital speed) is generated by a magnetic pickup, shaped and counted by specially-designed electronic printed circuitry, and passed on to the DEH Control System in the form of a digital numerical value. The second speed signal (which is called the analog speed) is generated by an identical independent magnetic pickup, processed in the analog backup circuitry for use there, and passed on to the DEH system as an analog input. The third speed signal (which is called the supervisory speed) is also generated by its own magnetic pickup, processed by supervisory instrumentation methods, and passed on to the DEH Control System as an analog input.

Figure 27:
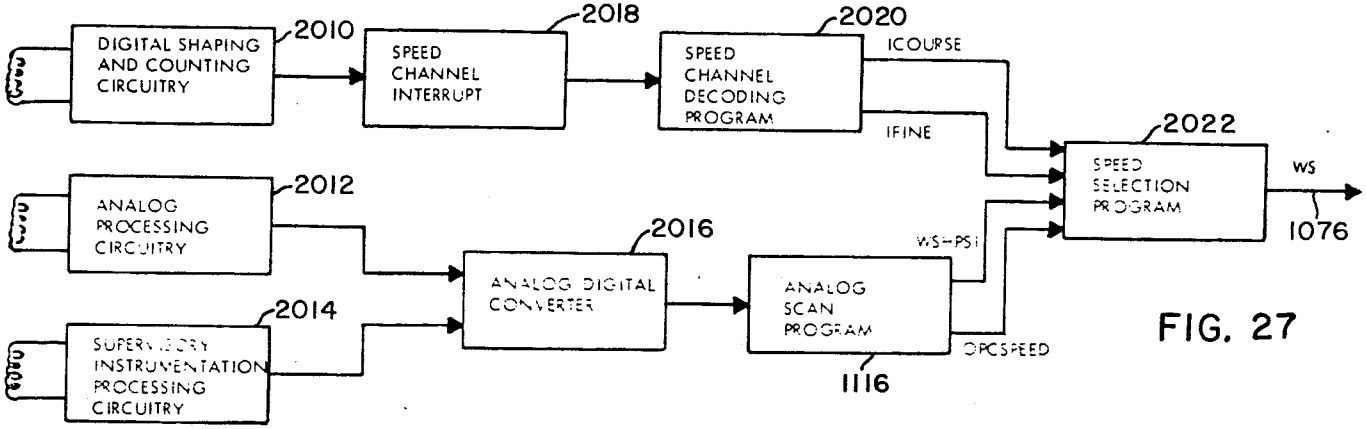
FIG. 27 shows a block diagram of a speed instrumentation and computation interface with special speed sensing circuitry which is operable in accordance with the principles of the invention.

Referring now to FIG. 27, a block diagram of the DEH speed instrumentation and computation interface is shown. A digital counting and shaping circuit 2010 described in the copending Ruether application Ser. No. 412,513 referred to supra, generates the highly accurate digital signal. The digital shaping and counting circuitry 2010 includes a magnetic pickup, a shaping and counting circuit which passes the data to the DEH computer in the form of a digital numerical value. The second or analog speed signal is generated by high accuracy analog processing circuitry 2012. The third or supervisory signal is generated by analog supervisory instrumentation processing circuitry 2014 and transmitted to an analog to digital converter 2016 with the signal from the high grade analog processing circuitry 2012.

The speed selection function determines which of these available speed inputs should be used in the DEH Control System. If the speed selection process concludes that the digital speed is reliable, then under all circumstances it is used as the controlling speed signal because it is the most accurate. If the selection process concludes that the digital speed is unreliable, the analog speed is used as the controlling speed signal since it is of acceptable accuracy. If neither the digital nor the analog speed signal is reliable, the speed selection function must disable the speed feedback control loop, because the supervisory speed is not of acceptable accuracy for controlling turbine speed response.

Although the supervisory speed is unacceptable for control requirements, it performs a valuable role in helping to determine which of the two speeds, digital or analog, is to be used in the DEH system. The speed selection accomplishes this by using a two-out-of-three logical error detection process to deduce the status of the digital and the analog speed signals. If either becomes unreliable, logical states are set which will turn on appropriate monitor lamps on the Operator A Panel. In addition, if a switch is made from the digital to the analog speed signal, or vice versa, while on load control, appropriate bumpless transfers are made with respect to the turbine reference and valve position outputs.

If both the digital and the analog speeds become unreliable, the speed selection function makes a more serious decision as to what control action to take. Thus, if the turbine is on wide-range speed operation, the DEH system must transfer to manual control and stop all speed control computations; this is necessary because the speed feedback information is unreliable. However, if the turbine is on load control, the DEH system simply opens the speed feedback loop bumplessly and continues on automatic control. This is acceptable because the speed feedback is simply a trim factor during load operation.

In the digital speed circuitry there are actually two numerical outputs, each of which is accurate in certain ranges. The quantity ICOURSE is a low-range course value which is appropriate from 0 to about 1600 rpm, while the quantity IFINE is a high-range vernier value which is appropriate from about 1600 to 4500 rpm. Thus, the speed selection function must determine which of these values to use in its two-out-of-three comparison with the remaining speed signals. The final result of the speed selection process is the value WS which is used by all other programs in the DEH system. The digital signal from the digital shaping and counting circuitry 2010 passes through a speed channel interrupt 2018 to a speed channel decoding program 2020 as shown in FIG. 27. In this speed counting program 2020 an output quantity designated ICOURSE is the low range course value used from about 0 to 1600 rpm, while the IFINE quantity is the high range fine value used between about 1600 and 4500 rpm.

An analog to digital converter 2016 makes both the high precision analog signals from the analog processing circuitry 2012 and the supervisory circuitry 2014 available to the analog scan program 1116 which in turn provides the represented speed values available to the speed selection program 2022. The speed selection program 2022 compares the digital speed value and the high grade analog speed value with the supervisory analog speed value in order to determine whether both the digital value and the high grade analog value are accurate or whether there is any discrepancy between the two. The supervisory speed value is generally not accurate enough for speed control. Therefore, the speed selection program 2022 makes use of the supervisory speed value to determine which of the high grade speed values is accurate if they are not equal.

The digital speed value from the digital shaping and counting circuitry 2010 is used as the reference WS at 1076, if it is found to be accurate enough for control purposes. The high grade analog speed value from the analog processing circuitry 2012 is utilized if the digital speed value is not accurate enough for control purposes. If either of the high grade signals becomes unreliable, appropriate monitor lamps on the control panel 1130 alert an operator to this fact.

Figure 28A:
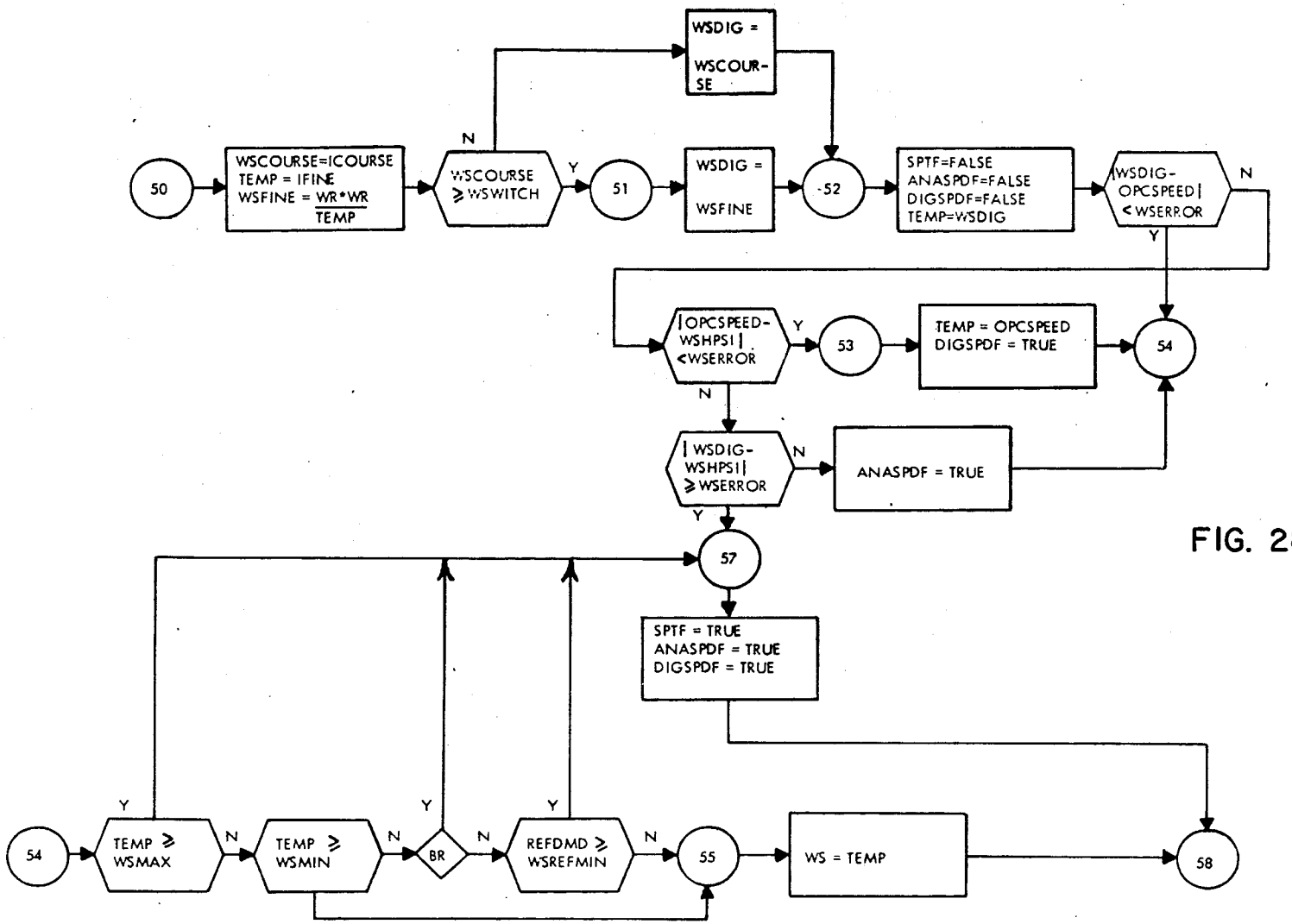
FIGS. 28A and 28B show flow charts of a speed selection function which is operable in accordance with the principles of the invention.
Figure 28B:
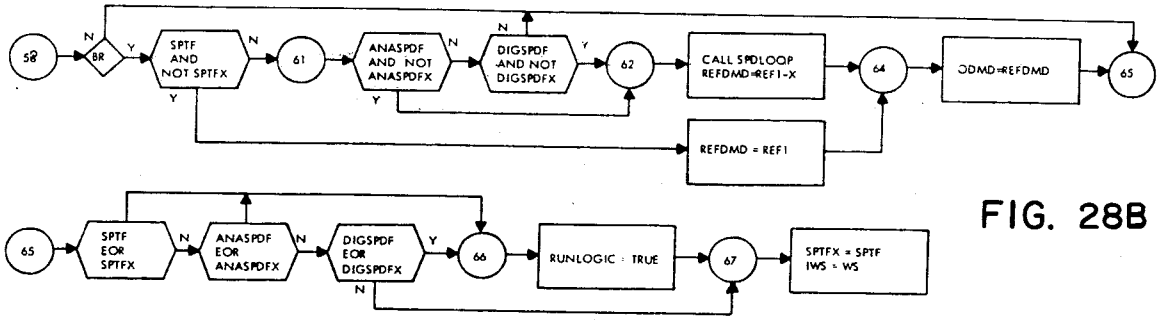

If both the high grade analog and the high grade digital speed values become unreliable and if the DEH system 1100 is on wide range speed control then a transfer takes place to the manual mode of control. However, if the turbine system 10 is on load control, the DEH system 1100 opens the speed feedback loop bumplessly and continues on automatic control with the remaining feedback loops intact. A flow chart for the speed selection subroutine is shown in FIGS. 28A and 28B.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode — pulse type contact input for adjusting the turbine speed reference and speed demand and moving the turbine 10 to synchronizing speed and phase.

2. Automatic turbine startup program mode — provides turbine speed demand and rate.

3. Operator automatic mode — speed, demand and rate of change of speed entered from the keyboard 1860 on the operator's panel 1130 shown in FIG. 12.

4. Maintenance test mode — speed demand and rate of change of speed are entered by an operator from the keyboard 1860 on the operator's control panel 1130 of FIG. 12 while the DEH system 1100 is being used as a simulator or trainer.

5. Manual tracking mode — the speed demand and rate of change of speed are internally computed by the DEH system 1100 and set to track the manual analog back-up system 1016 as shown in FIG. 4 in preparation for a bumpless transfer to the operator automatic mode of control.

With the breaker 17 closed and the turbine 10 in the level mode control, the following modes of operation may be selected.

1. Throttle pressure limiting mode — a contingent mode in which the turbine load reference is run back or decreased at a predetermined rate to a predetermined minimum value as long as a predetermined condition exists.

2. Run-back mode — a contingency mode in which the load reference is run back or decreased at a predetermined rate as long as a predetermined condition exists.

3. Automatic dispatch system mode — pulse type contact inputs are supplied from an automatic dispatch system to adjust turbine load reference and demand when the automatic dispatch system button 1870 on the operator's panel 1130 is depressed.

4. Operator automatic mode — the load demand and the load rate are entered from the keyboard 1830 on the control panel 1130 in FIG. 12.

5. Maintenance test mode — load demand and load rate are entered from the keyboard 1860 of the control panel 1130 in FIG. 12 while the DEH system 1100 is being used as a simulator or trainer.

6. Manual tracking mode — the load demand and rate are internally computed by the DEH system 1100 and set to track the manual analog back-up system 1016 preparatory to a bumpless transfer to the operator automatic mode of control.

Figure 29:
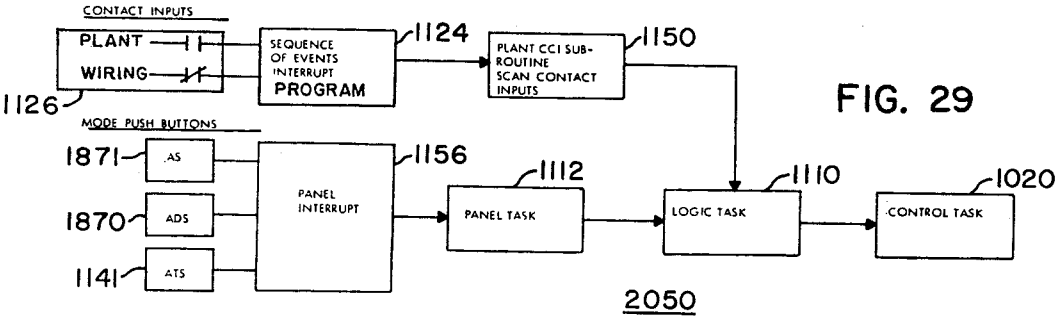
FIG. 29 shows a block diagram of an operating mode selection function which is operable in accordance with the principles of the invention.

Referring now to FIG. 29, a block diagram is shown illustrating the select operating mode function 2050. Contact inputs from plant wiring 1126 activate the sequence of events interrupt program 1124 which calls the plant contact input subroutine 1150, to scan the plant wiring 1126 for contact inputs. Mode pushbuttons such as automatic turbine startup 1141, automatic dispatch system 1170 and automatic synchronizer 1871 activate the panel interrupt program 1156 which calls the panel program 1112 for classification and which in turn calls upon the logic program 1110 to compute the logic states involved. The logic program 1110 calls the control program 1020 to select the operating mode in that program.

Figure 30:
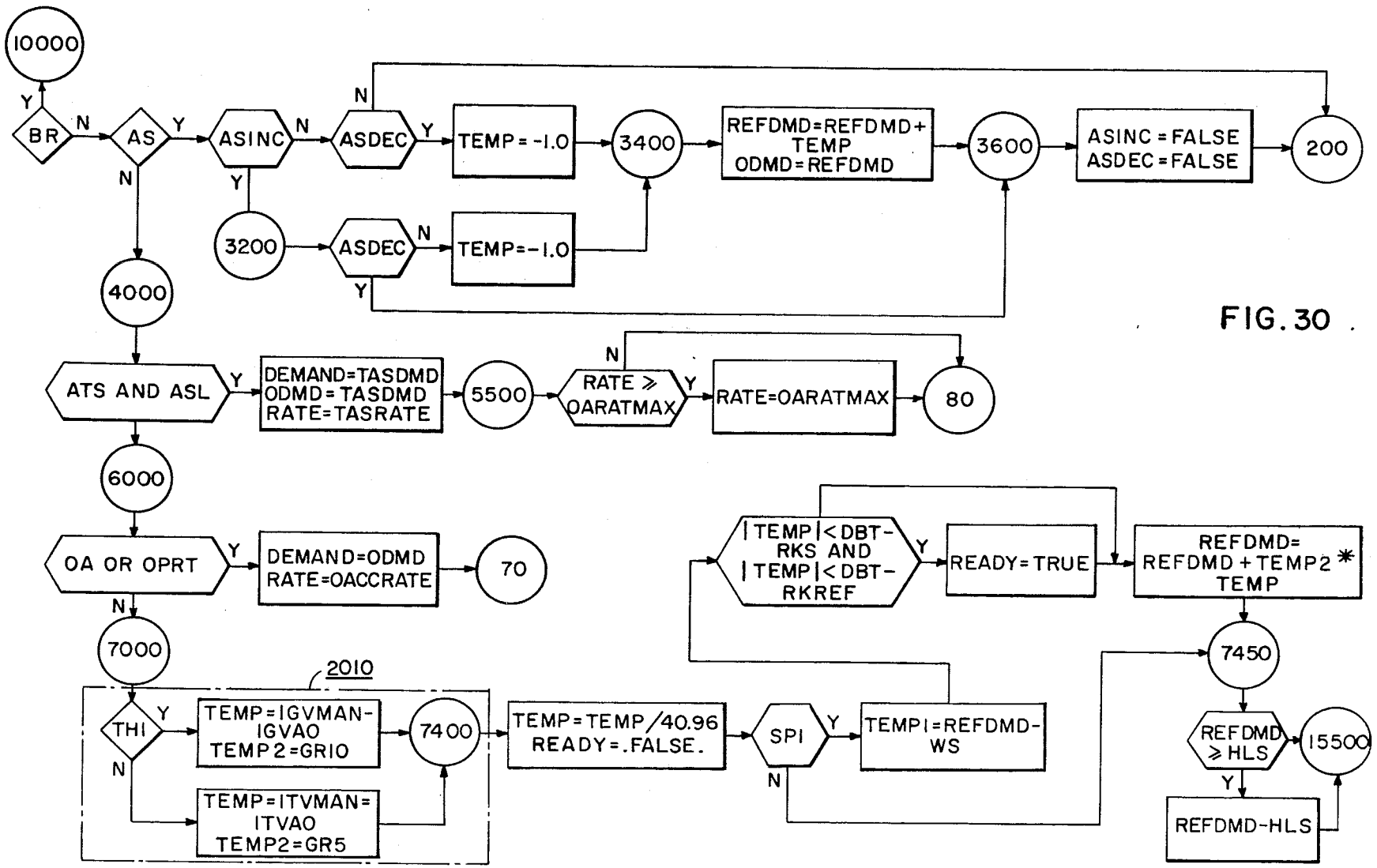
FIG. 30 shows a flow chart of a select operating mode function which is operable in accordance with the principles of the invention.

In FIG. 30 a flow chart of the select operating mode logic is shown. As one example of mode selection referring to a path 2023, after a statement 7000, provisions are made for a bumpless transfer from an automatic or test mode to an operator mode. The bumpless transfer is accomplished by comparing the computer outputs and the operator mode output signals for the governor valve GV1–GV4 positions. The DEH system 1110 inhibits any transfer until the error between the transferring output and the output transferred is within a predetermined deadband (DBTRKS). Bumpless transfer is accomplished by the DEH control system 1100 by comparing output from one mode of control of the governor valves GV and the throttle valves TV and the same output from another output mode controlling the same parameters. The flow chart of FIG. 30 shows mode selection for a complete operating system. In a hardwired or analog control system, the analog parameter output, to be transferred to must continuously track the parameter output to be transferred from. This tracking method is expensive and cumbersome since it has to be done continuously and requires complex hardware. However, in a digital system, such as the DEH control system 1100, the equating of the two parameter outputs need be performed only on transfer. Therefore, great economy of operation is achieved.

SPEED/LOAD REFERENCE FUNCTION

Figure 31:
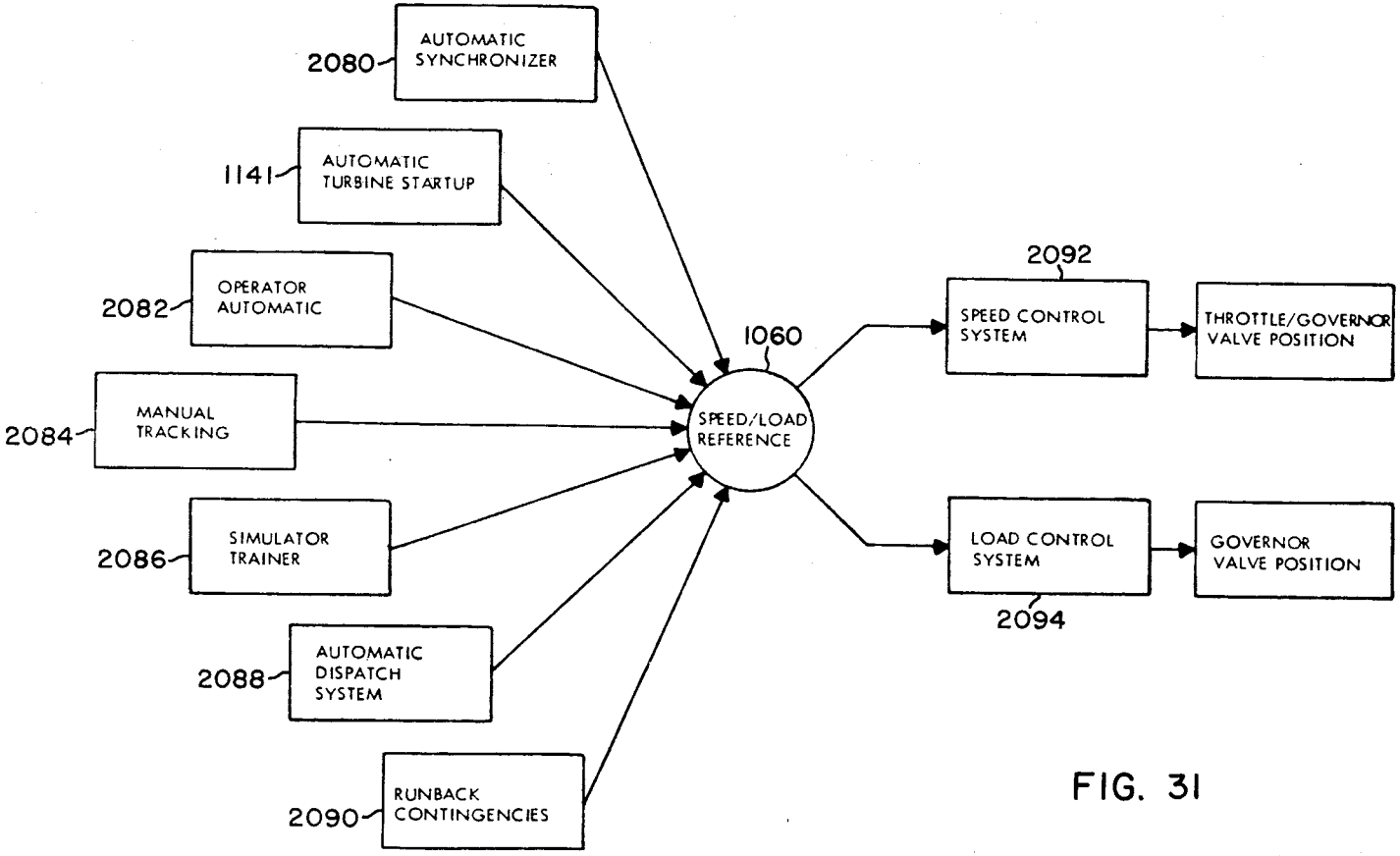
FIG. 31 shows a symbolic diagram of the use of a speed/load reference function which is operable in accordance with the principles of the invention; is operable in accordance with the principles of the invention.

The decision breaker function 1060, of FIG. 5, is identical to the speed/load reference function 1060, of FIG. 31. A software speed control subsystem 2092 of FIG. 62, corresponds to the compare function 1062, the speed reference 1066 and the proportional plus reset controller function 1068, of FIG. 5. The software load control subsystem 1094, of FIG. 31, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the proportional plus reset controller 1092, of FIG. 5. The speed/load reference 1060 is controlled by, depending upon the mode, and automatic synchronizer 1080, the automatic turbine starter program 1141, and operator automatic mode 1082, a manual tracking mode 2084, a simulator/trainer 2086, an automatic dispatch system 2088, or a run-back contingency load 2090. Each of these modes increments the speed/load reference function 1060 at a selected rate to meet a selected demand.

SPEED CONTROL FUNCTION

Figure 32:
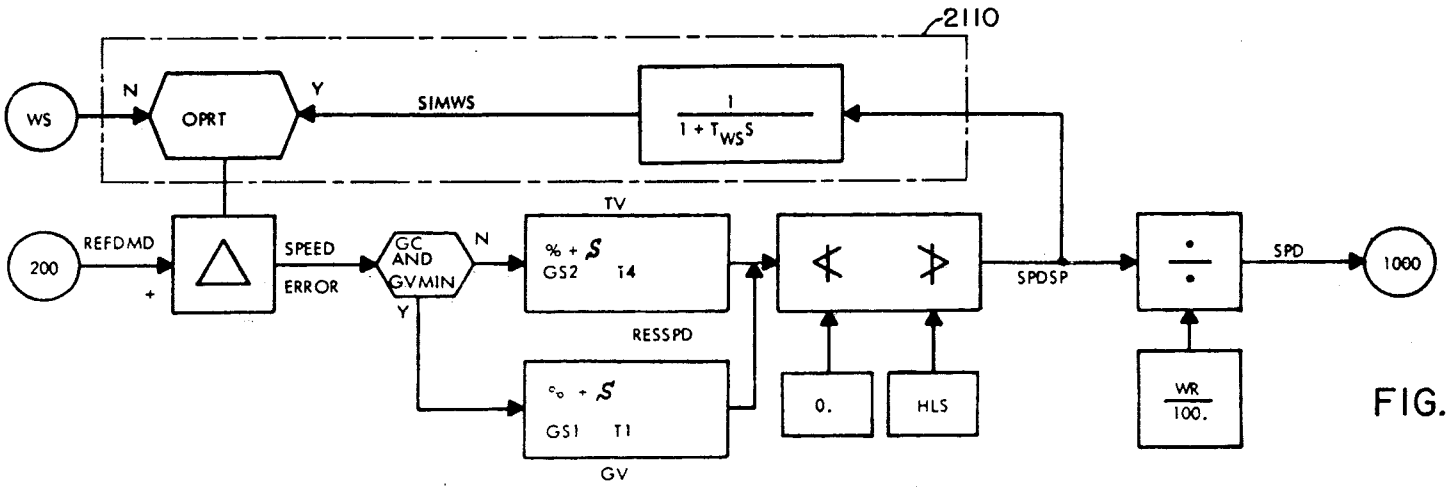
FIG. 32 is a block diagram showing a speed control function which is operable in accordance with the principles of the invention.

The speed control function positions the throttle and governor valves to achieve the existing speed reference with optimum dynamic and steady state response. This is accomplished by using individual proportional-plus-reset controllers for throttle and governor valve speed control, as shown in FIG. 32. The speed error between the turbine speed reference and actual speed drives the appropriate controller, which then reacts by positioning the proper valves to reduce the speed error to zero. The speed controller outputs are low-limit checked against zero and high-limit checked against the quantity HLS, which is a keyboard-entered constant set at 4200 rpm. This prevents the controllers from reaching a reset-windup condition which may inadvertently occur in odd circumstances. The speed controller output is then suitable ranged from 0 to 100 percent and sent downstream as the quantity SPD in the CONTROL task to the THROTTLE and GOVERNOR VALVE programs.

LOAD CONTROL FUNCTION

Figure 33:
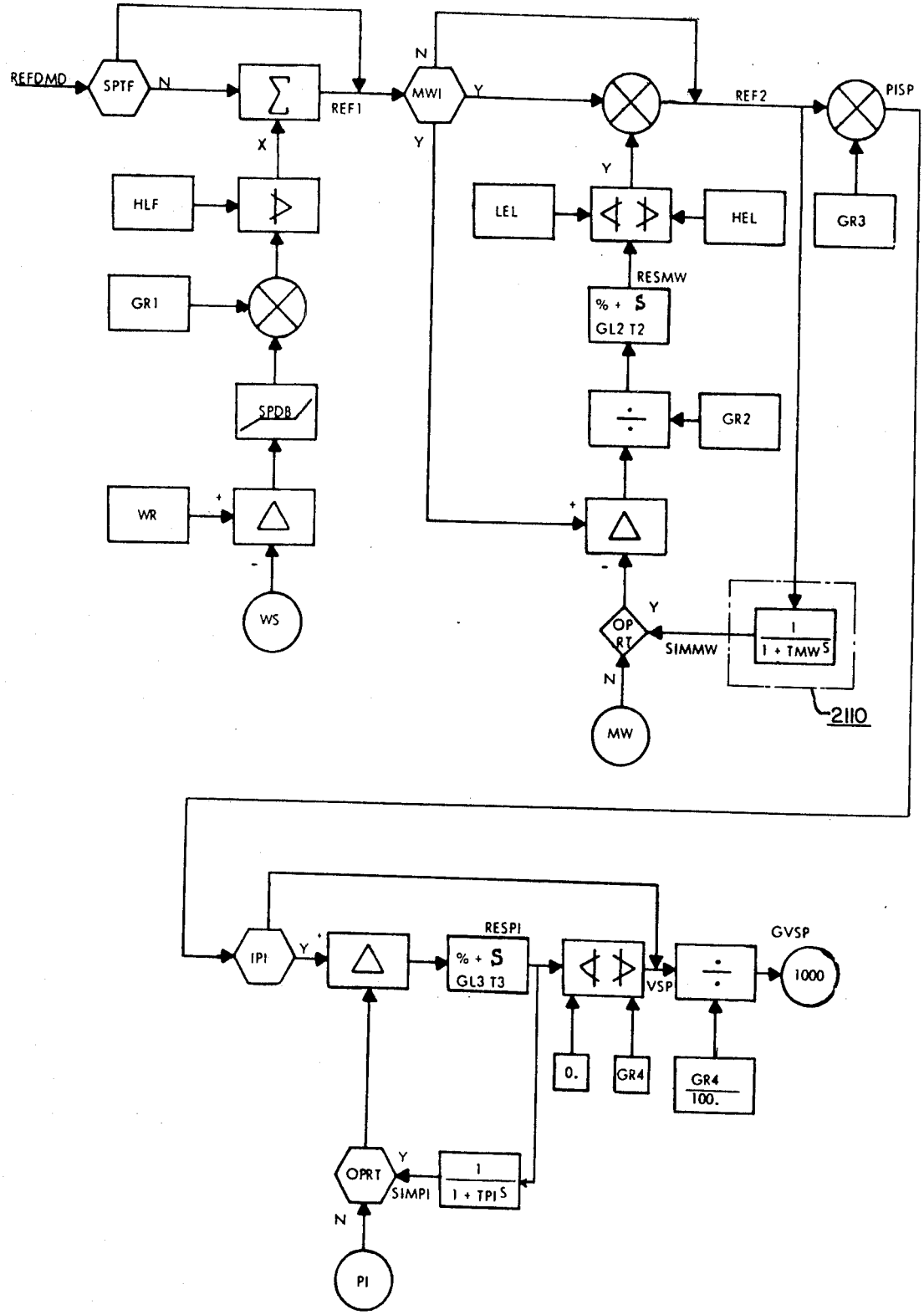
FIG. 33 shows a block diagram of the load control system which is operable in accordance with the principles of the invention.
Figure 34:
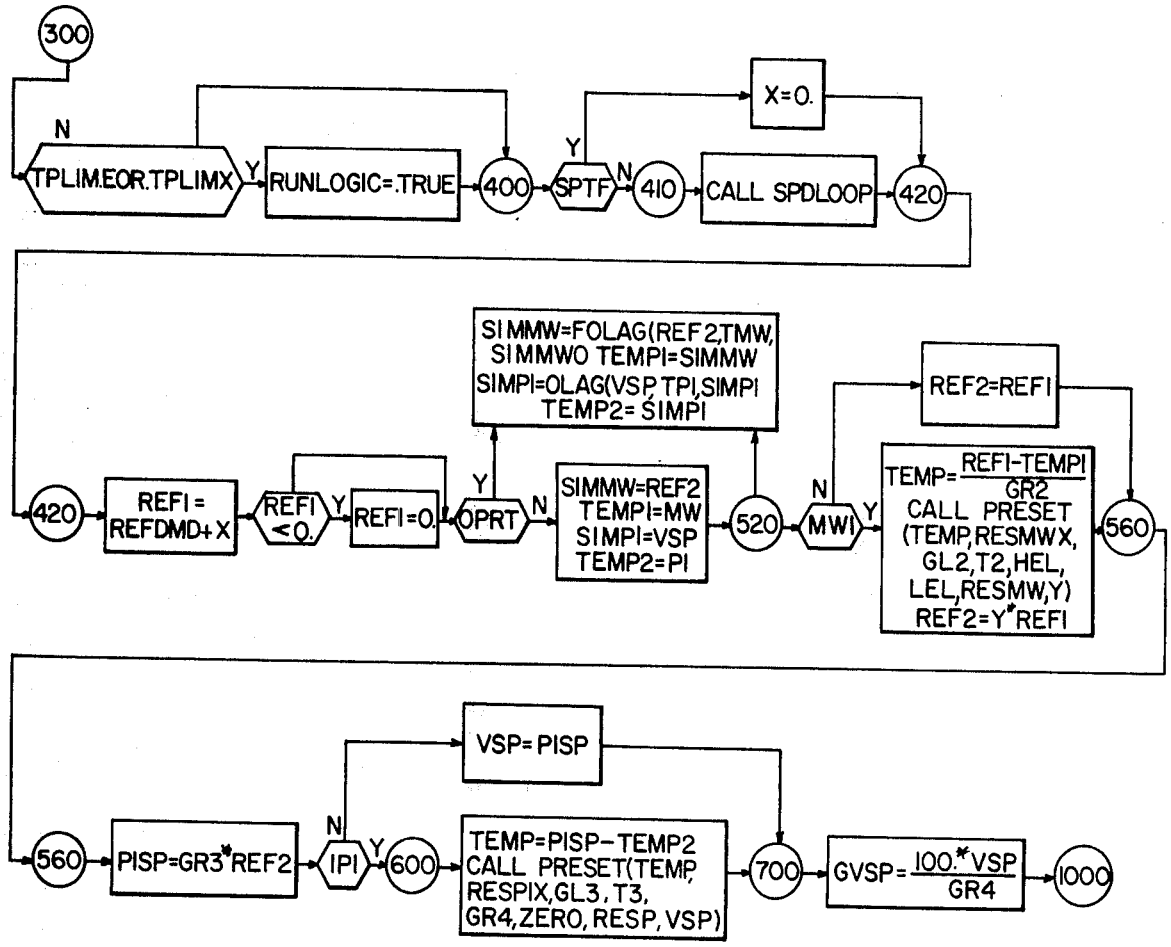
FIG. 34 includes a flow chart of the load control system which is operable in accordance with the principles of the invention.
Figure 35:
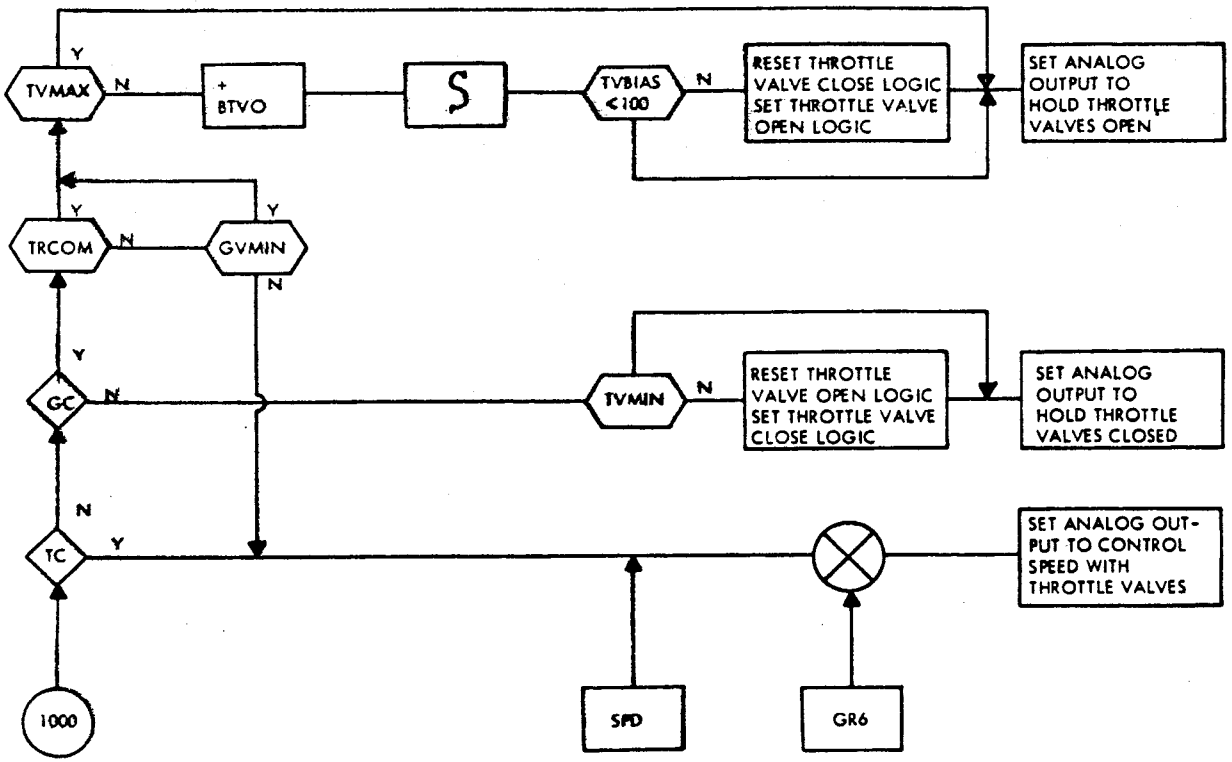
FIG. 35 shows a block diagram of the throttle valve control function which is operable in accordance with the principles of the invention.

The load control function block diagram shown in FIGS. 33 and 34 is an expansion of the load control, shown in FIG. 5, incorporating the speed loop subroutine and proportional control of function diagram of FIG. 9.

THROTTLE VALVE CONTROL FUNCTION

GOVERNOR VALVE CONTROL FUNCTION

Figure 36:
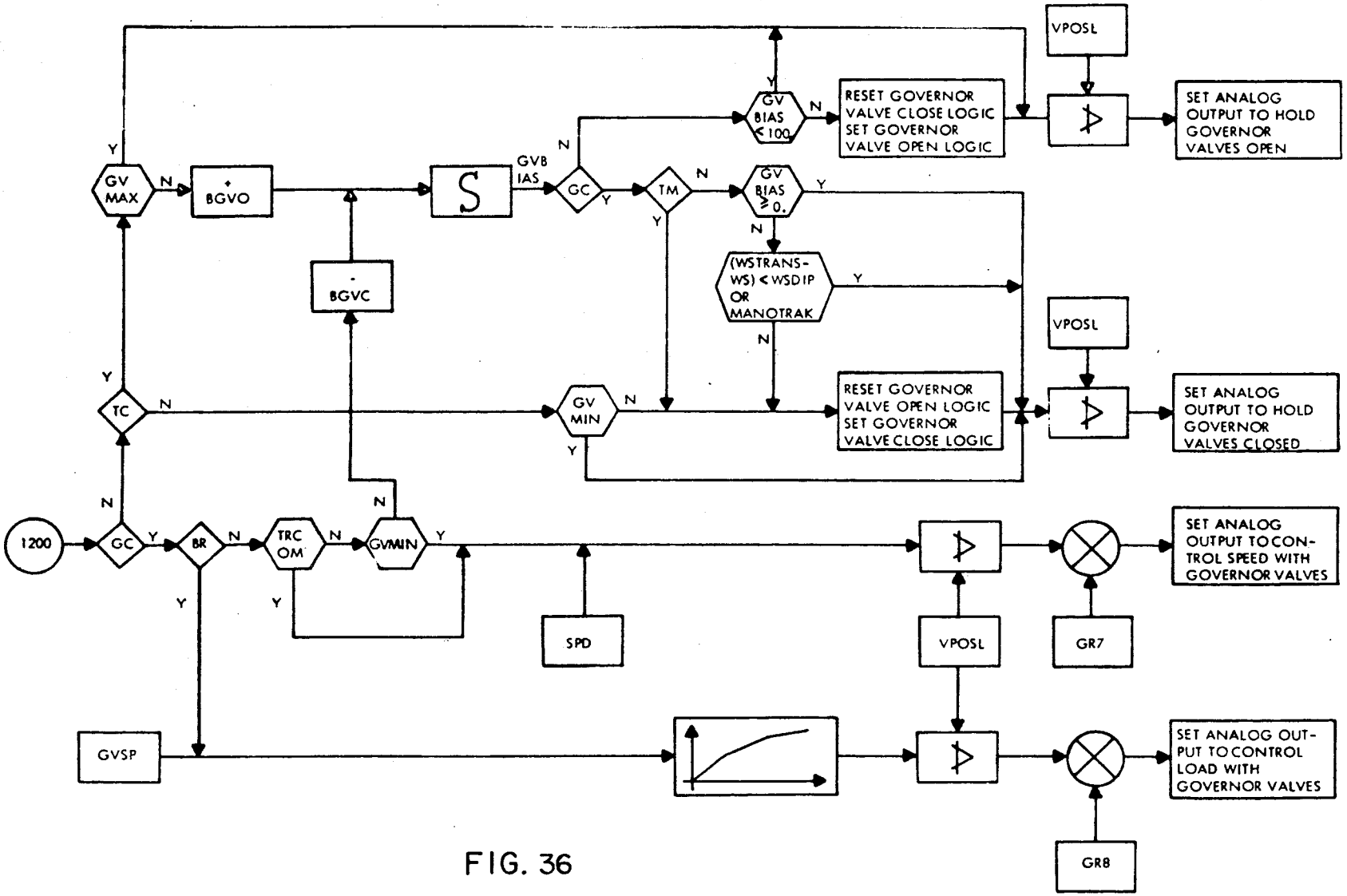
FIG. 36 shows a mixed block diagram of a governor control function program which is operable in accordance with the principles of the invention.
Figure 37:
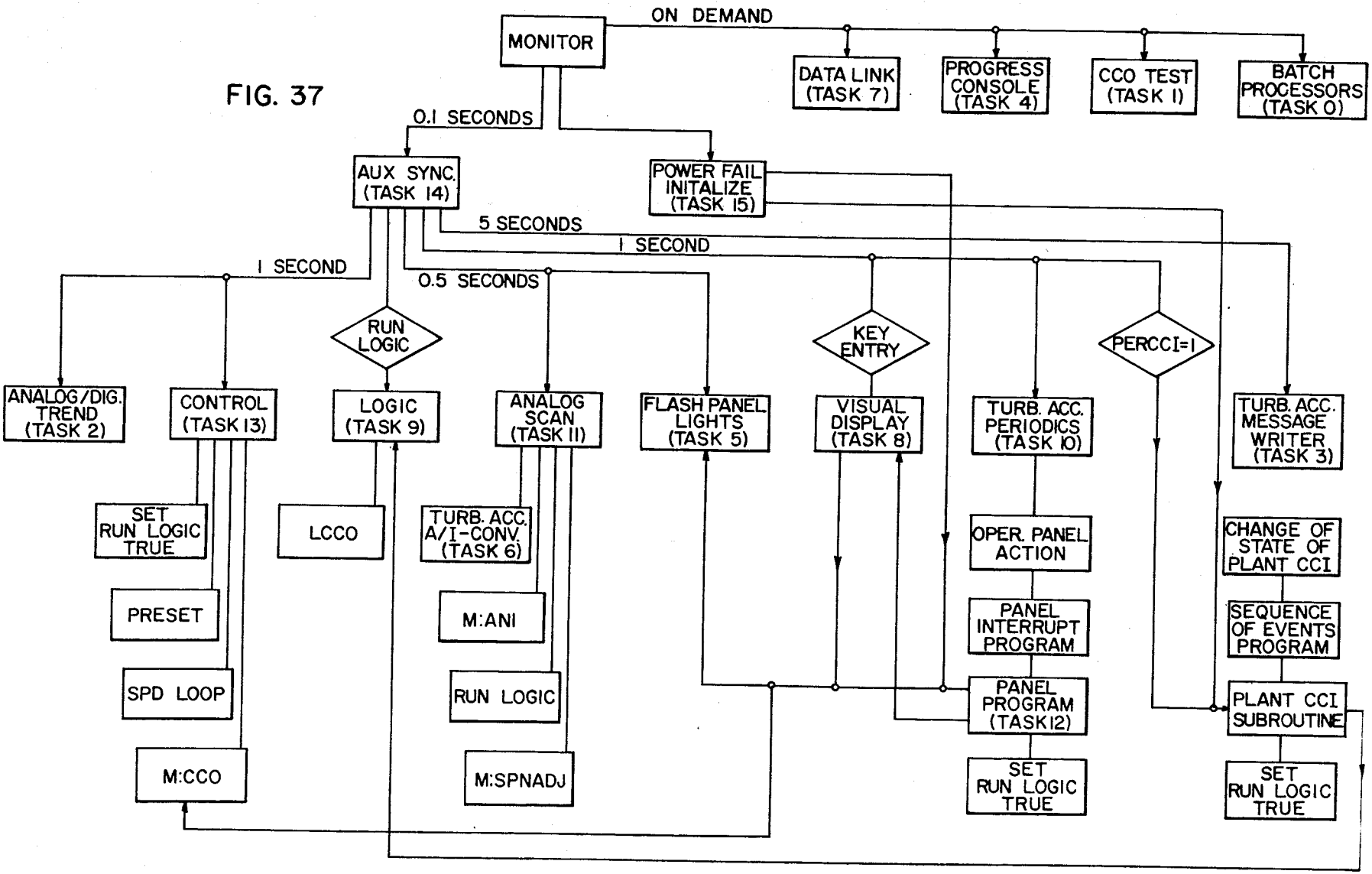
FIG. 37 shows a block diagram of the Digital Electro Hydraulic System which is operable in accordance with the principles of the invention.

FIG. 36 shows a block diagram of the governor valve control function which computes the position of the governor valve output at all times.

F. ANALOG BACKUP SYSTEM

The analog backup portion of the DEH Control System provides a second means, independent of the digital portion, of controlling the turbine valves. In the event of a failure in the digital portion, or during certain maintenance modes of operation, the Analog Backup System generates the signals necessary to control the valves, and thus the turbine.

While the digital portion of the control system is in service and in control of the turbine (the Operator Automatic mode), the analog system tracks the digital control signals. If the digital portion fails, or manual operation is selected, the DEH Control System transfers to the Analog Backup System without a change in valve position (bumpless transfer). When the analog portion is supplying the control signals (the Turbine Manual mode), the operator controls valve position using the manual pushbuttons on the Operator B Panel.

In addition to tracking and positioning capabilities, the Analog Backup System provides protection circuits. This protection capability is used during contingency conditions, and duplicates similar protection provided by the digital portion of the DEH Control System. Thus, the operator is provided with an effective means of operating the turbine during a contingency condition or during maintenance or testing of the system.

Modes Of Operation

In the Turbine Manual mode of operation, the operator controls the turbine using the Analog Backup System. The mode of operation (Operator Automatic or Turbine Manual) of the DEH Control System is determined by the state of a flip-flop (the Turbine Manual flip-flop). When this flip-flop is reset, the Analog Backup System is controlling the turbine (Turbine Manual mode). When the Turbine Manual flip-flop is set, the Digital Controller is controlling the turbine (Operator Automatic mode) and the Analog Backup System is tracking the Digital System.

If the Analog Backup System is in control, the operator must press the OPER AUTO button on the Operator B Panel to transfer to the Operator Automatic mode of operation (flip-flop is set). At the same time, however, a permissive generated by the digital portion must be maintained. If an internal failure in the digital portion causes the permissive to be absent, the DEH Control system remains in Turbine Manual even if the OPER AUTO button is pressed.

The Turbine Manual flip-flop can be reset (the DEH Control System goes from the Operator Automatic to the Turbine Manual mode) in several ways. If the operator presses the TURBINE MANUAL button on the Operator B Panel, the DEH Control System is placed in the Turbine Manual mode. Also, a contact closure generated by the digital portion (indicating a failure in the digital portion) causes the system to be placed in the Turbine Manual mode. In the event of a power supply failure in the digital portion, a contact closure is generated which resets the Turbine Manual Flip-flop (Turbine Manual mode).

Two speed channels are located in the Analog Backup System: an analog speed channel and a digital speed channel. The analog speed channel detects a system overspeed condition by comparing an analog speed signal to a reference voltage. The analog speed signal is also sent to the digital portion of the control system and to the rpm meter on the Operator B Panel. The digital speed channel shapes the input speed signal (analog) and uses a 36 kHz clock to convert the analog signal to a corresponding digital signal. This digital signal is then applied to circuits in the digital portion of the control system.

Digital And Analog Speed Channels

The output of the analog speed channel cards is checked against a high and a low limit; if either limit is exceeded, corresponding failure signals are generated. The only speed channel output is also compared to an overspeed set point (OSTPZI) which is generated by a scaling amplifier. The resulting signal indicates when the speed is above the set point. If the speed is above the set point, and the Digital Controller has determined that no failure has occurred in the analog speed channel, and the high limit has not been exceeded, a signal is generated for use by the Overspeed Protection Controller (OPC) circuitry.

The analog speed channel signal is also applied to the rpm meter on the Operator A Panel, and to the Digital Controller. The controller uses the analog speed signal in a two-out-of-three selection process to determine which speed channel is to be used. The digital circuitry consists of a coarse channel (used for the entire speed range) and a fine channel (used only above 1600 rpm-synchronous speed) as previously mentioned.

The speed input (sine-wave frequency) is applied to the Speed Channel A. This input is doubled and shaped, and applied (through logic circuitry) to a Counter Card in the Digital Controller. The Counter Card feeds a Register Comparator Card; the output of which is applied to the computer. This channel (coarse) works for the whole range of turbine speed; it has an accuracy of +10 rpm. A 0.1 sec time base is provided by a 36 kHz clock which is counted by another Counter Card.

The fine channel counts the 36 kHz clock for a period of time dependent on the speed input. This method increases the accuracy to ± rpm at 3600 rpm (since the clock pulse might be missing). However, the fine channel can be used only above 1600 rpm. In both cases, the Digital Controller uses a software program to determine the speed channel used and the count.

I claim:

1. An electric power generating system having a steam turbine, a steam generator for supplying steam to the turbine, an electric generator rotatable by said turbine and adapted to be connected to an electrical load, said system comprising:

valve means for controlling the flow of steam from the steam generator to the turbine to control the operation of the turbine;

means to generate an electrical signal representative of steam flow demand;

valve actuating means governed by the steam flow demand signal to control the operation of the valve means;

speed sensing means for sensing at least the magnitude of the turbine speed, said speed sensing means including means to generate at least first, second, and third independent electrical signals representative of turbine speed;

calculating means governed by the generated speed signals to at times control the steam flow demand signal in accordance with the selected first or second speed signal, said calculating means including sequence controlling means having the following components:

a. means for comparing said first, second, and third speed signals, b. means governed by the comparison means to determine whether said first, second, and third speed signals differ from each other by a predetermined magnitude, c. selection means governed by the determining means to select the first speed signal in response to a first condition where said first and second signals differ from each other by an amount less than said predetermined magnitude, or where said first signal differs from the third signal by an amount less than said predetermined magnitude while the second and third signals differ from each other by at least said predetermined magnitude, and to select the second speed signal in response to a second condition where the second and third signals differ from each other by an amount less than said predetermined magnitude while the first and second signals differ from each other by at least said predetermined magnitude; and d. means to switch to the selected speed signal in response to a change between the first condition and the second condition.

2. An electric power generating system according to claim 1 wherein the speed signal generating means includes means to generate both a coarse speed signal and a fine speed signal to constitute one of at least the first and second speed signals, the sequencing means further includes, a. means to compare both the fine and coarse speed signals, b. means to select one of said fine and coarse speed signals at times when both said fine and coarse speed signals represent a turbine speed below a predetermined magnitude, c. means to select the other of the fine and coarse speed signals at times when both said fine and coarse speed signals represent a turbine speed above a predetermined magnitude, whereby said selected signal constitutes at least one of the first and second speed signals.

3. A system according to claim 2 wherein the sequencing means is structured in a programmed digital computer means.

4. A system according to claim 1 wherein the signal generating means for one of the first and second speed signals generates a digital signal for input to the calculating means and generates for the other of the first and second speed signals an analog signal; and said system further includes means to convert the analog signal to a digital signal for the calculating means.

5. A system according to claim 1 wherein the calculating means is structured in a programmed digital computer means.

6. An electric power generating system having a steam turbine, a steam generator for supplying steam to the turbine, and an electric generator rotatable by said turbine to supply an electric load, said system comprising:

a. means for converting input signals to digital data;

b. means for converting digital data to output signals;

c. means for sensing the speed of the steam turbine and for generating at least three independent signals representative of said speed, said sensing means being connected to the input converting means to convert at least one of the speed signals to digital data, d. a calculating means including a sequencing means having the following components;

d1. means to compare the three speed signals, d2. means governed by the comparison means to determine whether said three speed signals differ from each other by a predetermined magnitude, d3. means governed by the determining means to select a first of the three speed signals in response to a first condition where said first signal differs from the second signal by an amount less than said predetermined magnitude, or where said first signal differs from the third signal by an amount less than said predetermined magnitude while the second and third signals differ from each other by at least said predetermined magnitude, and to select the second of the three speed signals in response to a second condition where the second and third speed signals differ from each other less than said predetermined magnitude while the first and second signals differ from each other by at least said predetermined magnitude;

e. means connecting the input and output converting means to the calculating means;

f. means to control the steam flow to the turbine;

g. means connecting the output converting means to said steam flow control means; and h. means for governing the output converting means to at times vary the steam flow control means in accordance with the selected first or second speed signal.

7. An electric power generating system according to claim 6 wherein the turbine speed generating means includes means to generate a coarse speed signal and a fine speed signal for one of the speed signals; and said calculating means further includes, a. means to compare both the coarse and fine speed signals with a predetermined speed value, and b. means governed by the comparing means to select one of the coarse and fine signals as one of the speed signals in accordance with the predetermined speed value.

8. An electric power generating system according to claim 7 wherein the coarse and fine speed signals are digital signals.

9. An electric power generating system comprising:

a. a steam turbine system b. a steam generator for providing steam to the steam turbine system, c. an electric generator rotatable by said turbine system and adapted to be connected to an electrical load:

d. means for digitally computing and processing;

e. means for converting input signals to digital data, said input converting means connected to said digital computing means;

f. means for sensing the magnitude of turbine speed;

g. means governed by the sensing means to generate a first digital data signal representative of turbine speed;

h. means governed by the sensing means to generate a second and third signal representative of turbine speed, at least one of said signals being an analog speed signal;

i. means for converting input signals including the analog speed signal to digital data, said input converting means connected to the digital computing means;

j. means connecting the first speed signal to the digital computing means;

k. said digital computing means including sequencing means having the following components, i. means to compare the difference between the magnitude of the first, second, and third speed signals, i2. means governed by the comparing means to select the first speed signal at times when a first predetermined combination of the first and second speed signals differ from each other less than a predetermined magnitude, i3. means governed by the comparing means to switch from the first signal to select the second speed signal at times when second predetermined combination of the first, second, and third speed signals differ from each other less than a predetermined magnitude;

l. means for converting digital data including the selected speed signal to output signals, said digital to output converting means connected to the digital computing means;

m. means for controlling the steam flow to the turbine; and n. means including the selected one of the first and second speed signals to modify at times the steam flow controlling means in accordance with the sensed speed magnitude.

10. A system according to claim 9 wherein the first speed signal generating means provides a coarse speed signal and a fine speed signal, said digital computer means further includes sequencing means having, a. means to compare the coarse and fine speed signals with a predetermined speed magnitude, and b. means governed by the comparing means to select one of the coarse and fine speed signals as the first speed signal in accordance with the predetermined speed magnitude.

11. A system according to claim 9 further including:

a circuit breaker for connecting and disconnecting the electric generator load when in a respective closed and open operating condition;

means to sense the operating condition of the circuit breaker and to generate a signal corresponding to either an open or closed condition;

said digital computer means further including, sequencing means governed by the circuit breaker signal and the speed signal selection means to maintain the steam flow control means at a substantially identical position in response to the switching from one selected speed signal to the other when the breaker is in a closed condition.

12. A system according to claim 11 wherein the digital computer means further includes sequencing means governed by the comparing means to generate a fourth signal at times when a predetermined combination of the first, second, and third speed signals differ from each other by an amount greater than a predetermined magnitude; and means responsive to the fourth signal to disconnect the selected speed signal from the steam flow controlling means.

* * * * *